US012234002B2

(12) United States Patent
Shirao et al.

(10) Patent No.: US 12,234,002 B2
(45) Date of Patent: Feb. 25, 2025

(54) SHIP PROPULSION DEVICE CONTROLLER, SHIP PROPULSION DEVICE CONTROL METHOD, AND PROGRAM

(71) Applicant: NHK SPRING Co., Ltd., Yokohama (JP)

(72) Inventors: Masato Shirao, Yokohama (JP); Marino Akita, Yokohama (JP); Takafumi Oshima, Yokohama (JP)

(73) Assignee: NHK SPRING CO., LTD., Yokohama (JP)

( * ) Notice: Subject to any disclaimer, the term of this patent is extended or adjusted under 35 U.S.C. 154(b) by 347 days.

(21) Appl. No.: 17/616,316

(22) PCT Filed: Jun. 5, 2020

(86) PCT No.: PCT/JP2020/022289
§ 371 (c)(1),
(2) Date: Dec. 3, 2021

(87) PCT Pub. No.: WO2020/246582
PCT Pub. Date: Dec. 10, 2020

(65) Prior Publication Data

US 2022/0306263 A1 Sep. 29, 2022

(30) Foreign Application Priority Data

Jun. 6, 2019 (JP) ..... 2019-106521

(51) Int. Cl.
*B63H 21/21* (2006.01)
*B63H 25/42* (2006.01)

(52) U.S. Cl.
CPC ..... *B63H 25/42* (2013.01); *B63H 21/21* (2013.01)

(58) Field of Classification Search
CPC .. B63H 25/42; B63H 21/21; B63H 2025/026; B63H 25/02
See application file for complete search history.

(56) References Cited

U.S. PATENT DOCUMENTS 9,908,606 B1 3/2018 Andrasko et al.
2007/0017426 A1 1/2007 Kaji et al.
(Continued)

FOREIGN PATENT DOCUMENTS

JP H01285486 A 11/1989
JP 2005200004 A 7/2005
(Continued)

OTHER PUBLICATIONS

International Search Report for International Application No. PCT/JP2020/022289; Date of Mailing, Aug. 18, 2020.

*Primary Examiner* — Jelani A Smith
*Assistant Examiner* — Nada Mahyoob Alqaderi
(74) *Attorney, Agent, or Firm* — CANTOR COLBURN LLP

(57) ABSTRACT

A ship propulsion device controller controls a plurality of ship propulsion devices disposed on a rear portion of a hull of a ship. The ship includes an operation unit configured to operate the ship propulsion devices. The operation unit is able to be positioned at a first position where the ship propulsion devices do not generate propulsion forces for the ship and a second position where the ship propulsion devices generate propulsion forces for moving the ship in a right direction, a right-forward direction, or a right-backward direction or a third position where the ship propulsion devices generate a propulsion force for moving the ship in a left direction, a left-forward direction, or a left-backward direction. When the operation unit is moved from the first position to the second position and maintained at the second position, the ship propulsion devices generate a clockwise
(Continued)

rotating moment in the ship during a first period from a first timing when the operation unit is moved to the second position to a second timing and do not to generate the clockwise rotating moment in the ship during a second period after the second timing.

8 Claims, 14 Drawing Sheets

(56) References Cited

U.S. PATENT DOCUMENTS

| | | | | |
|---|---|---|---|---|
| 2010/0191396 | A1* | 7/2010 | Nose | B63H 25/42 701/21 |
| 2010/0191397 | A1* | 7/2010 | Nose | B63H 25/42 701/21 |
| 2011/0166724 | A1* | 7/2011 | Hiramatsu | B63H 25/42 702/85 |

FOREIGN PATENT DOCUMENTS

| | | | | | |
|---|---|---|---|---|---|
| JP | 2011140272 | A | | 7/2011 | |
| JP | 2015116847 | A | * | 6/2015 | B63H 11/00 |
| JP | 5987624 | B2 | | 8/2016 | |
| JP | 2018002040 | A | | 1/2018 | |
| JP | 6696704 | B2 | * | 5/2020 | B63B 79/15 |
| KR | 20170120864 | A | | 11/2017 | |

* cited by examiner

LEFT
FRONT
RIGHT
REAR
P1

LEFT
FRONT
RIGHT
REAR
P2

LEFT
FRONT
RIGHT
REAR
P3
θ3

LEFT
FRONT
RIGHT
REAR
P4
θ4

LEFT
FRONT
RIGHT
REAR
P5

LEFT
FRONT
RIGHT
REAR
P6
θ6

LEFT
FRONT
RIGHT
REAR
P7
θ7

LEFT
FRONT
RIGHT
REAR
P8

LEFT
FRONT
RIGHT
REAR
P9

P2
POSITION OF OPERATION UNIT
P1

RESULTANT FORCE
RR1, RR2
0

ACUTE ANGLE
θ12
θ11
0

PROPULSION FORCE
DF121, DF131
DF122, DF132
0

CLOCKWISE
M1
ROTATING MOMENT
0
COUNTERCLOCKWISE
t1
t2

P5
POSITION OF OPERATION UNIT
P1

RESULTANT FORCE
RL3, RL4
0

ACUTE ANGLE
θ14
θ13
0

PROPULSION FORCE
DF123, DF133
DF124, DF134
0

COUNTERCLOCKWISE
M2
ROTATING MOMENT
0
CLOCKWISE
t3
t4

P2
POSITION OF OPERATION UNIT
P1
RESULTANT FORCE

RR1, RR2
0
ACUTE ANGLE

θ12
θ11
0
PROPULSION FORCE

DF121, DF131
DF122, DF132
0
CLOCKWISE

M1
ROTATING MOMENT
0
COUNTERCLOCKWISE
t1
t2

P5
POSITION OF OPERATION UNIT
P1

RESULTANT FORCE
RL3, RL4
0

ACUTE ANGLE
θ14
θ13
0

PROPULSION FORCE
DF123, DF133
DF124, DF134
0

COUNTERCLOCKWISE
M2
ROTATING MOMENT
0
CLOCKWISE
t3
t4

SHIP PROPULSION DEVICE CONTROLLER, SHIP PROPULSION DEVICE CONTROL METHOD, AND PROGRAM

CROSS REFERENCE TO RELATED APPLICATIONS

This is the U.S. national stage of application No. PCT/JP2020/022289, filed on Jun. 5, 2020. Priority under 35 U.S.C. § 119(a) and 35 U.S.C. § 365(b) is claimed from Japanese Application No. 2019-106521 filed Jun. 6, 2019, the disclosure of which is also incorporated herein by reference.

TECHNICAL FIELD

The present invention relates to a ship propulsion device controller, a ship propulsion device control method, and a program.

BACKGROUND ART

Conventionally, a ship control device capable of allowing moving and turning in any direction is known (see, for example, Patent Literature 1). In technology described in Patent Literature 1, two propulsion units capable of arbitrarily setting a direction and strength of a propulsion force are installed on the left and right sides of a stem and the direction and strength of the propulsion force of each propulsion unit are controlled, so that a composite force with which the ship can move in a desired direction and a composite force with which the ship can turn in a desired direction act on a hull. Specifically, in Patent Literature 1, an example in which a joystick is described as an omnidirectional controller and the hull moves just to the side while maintaining its attitude is described. Also, in Patent Literature 1, an example in which the hull moves diagonally forward or diagonally backward while maintaining its attitude is described.

Incidentally, in Patent Literature 1, when a tip of a lever of the joystick is moved from a neutral position where the lever is not tilted to a right tilt position where the lever is tilted to the right, a relationship between an elapsed time period from a timing when the tip of the lever of the joystick is moved to the right tilt position and a magnitude of a turning moment (a rotating moment) of the hull generated by the two propulsion units is not described.

Also, conventionally, a control device for controlling two outboard motors attached to a rear portion of a hull of a ship in accordance with an operation by a joystick capable of tilting the ship from a neutral state in all directions is known (see, for example, Patent Literature 2). In technology described in Patent Literature 2, when the joystick is tilted to the right, the control device causes the two outboard motors to generate a propulsion force with which the ship performs a parallel movement to the right. Also, in the technology described in Patent Literature 2, when the joystick has been tilted to the right front side, the control device causes the two outboard motors to generate a propulsion force with which the ship performs a parallel movement in a right-forward direction.

Incidentally, in Patent Literature 2, when the tip of the lever of the joystick is moved from a neutral position to a right tilt position, a relationship between an elapsed time period from a timing when the tip of the lever of the joystick is moved to the right tilt position and a magnitude of a rotating moment of the hull generated by the two outboard motors is not described.

CITATION LIST

Patent Literature

[Patent Literature 1]
Japanese Unexamined Patent Application, First Publication No. H1-285486
[Patent Literature 2]
Japanese Patent No. 5987624

SUMMARY OF INVENTION

Technical Problem

A ship operator moves a tip of a lever of a joystick from a neutral position to a right tilt position so that a ship, which is stopped, is moved to the right.

From intensive research, the inventors of the present invention and the like have found that, in a ship in which a ship propulsion device is disposed on a rear portion of a hull and is not disposed on a front portion of the hull, when a tip of a lever of a joystick is moved from a neutral position to a right tilt position, if the ship propulsion device generates only a rightward propulsion force, a start of a rightward movement of the front portion of the hull is later than a start of a rightward movement of the rear portion of the hull, so that the ship turns counterclockwise (i.e., the attitude of the hull changes and the front and rear portions of the hull do not perform a translational movement to the right).

In view of the above-described problems, an objective of the present invention is to provide a ship propulsion device controller, a ship propulsion device control method, and a program capable of restricting a ship from turning due to the start of a movement of a front portion of a hull being later than the start of a movement of a rear portion of the hull when the ship, which is stopped, is moved.

Solution to Problem

From intensive research, the inventors of the present invention and the like have found that a translational movement is performed in a right direction without the start of a movement of a front portion of a hull being later than the start of a movement of a rear portion of the hull (i.e., without the turning of a ship) when a ship propulsion device initially generates a clockwise rotating moment in the ship and generates a rightward propulsion force and subsequently generates a rightward propulsion force without generating a clockwise rotating moment in the ship, for example, if a tip of a lever of a joystick is moved from a neutral position to a right tilt position.

Also, from intensive research, the inventors of the present invention and the like have found that a translational movement is performed in a right-forward direction without the start of a movement of a front portion of a hull being later than the start of a movement of a rear portion of the hull (i.e., without the turning of a ship) when a ship propulsion device initially generates a clockwise rotating moment in the ship and generates a right-forward propulsion force and subsequently generates a right-forward propulsion force without generating a clockwise rotating moment in the ship, for example, if a tip of a lever of a joystick is moved from a neutral position to a right-forward tilt position.

Further, from intensive research, the inventors of the present invention and the like have found that a translational movement is performed in a right-backward direction without the start of a movement of a front portion of a hull being later than the start of a movement of a rear portion of the hull (i.e., without the turning of a ship) when a ship propulsion device initially generates a clockwise rotating moment in the ship and generates a right-backward propulsion force and subsequently generates a right-backward propulsion force without generating a clockwise rotating moment in the ship, for example, if a tip of a lever of a joystick is moved from a neutral position to a right-backward tilt position.

Likewise, from intensive research, the inventors of the present invention and the like have found that a translational movement is performed in a left direction without the start of a movement of a front portion of a hull being later than the start of a movement of a rear portion of the hull (i.e., without the turning of a ship) when a ship propulsion device initially generates a counterclockwise rotating moment in the ship and generates a leftward propulsion force and subsequently generates a leftward propulsion force without generating a counterclockwise rotating moment in the ship, for example, if a tip of a lever of a joystick is moved from a neutral position to a left tilt position.

Also, from intensive research, the inventors of the present invention and the like have found that a translational movement is performed in a left-forward direction without the start of a movement of a front portion of a hull being later than the start of a movement of a rear portion of the hull (i.e., without the turning of a ship) when a ship propulsion device initially generates a counterclockwise rotating moment in the ship and generates a left-forward propulsion force and subsequently generates a left-forward propulsion force without generating a counterclockwise rotating moment in the ship, for example, if a tip of a lever of a joystick is moved from a neutral position to a left-forward tilt position.

Further, from intensive research, the inventors of the present invention and the like have found that a translational movement is performed in a left-backward direction without the start of a movement of a front portion of a hull being later than the start of a movement of a rear portion of the hull (i.e., without the turning of a ship) when a ship propulsion device initially generates a counterclockwise rotating moment in the ship and generates a left-backward propulsion force and subsequently generates a left-backward propulsion force without generating a counterclockwise rotating moment in the ship, for example, if a tip of a lever of a joystick is moved from a neutral position to a left-backward tilt position.

According to an aspect of the present invention, there is provided a ship propulsion device controller for controlling a plurality of ship propulsion devices disposed on a rear portion of a hull of a ship, wherein each of the plurality of ship propulsion devices includes a propulsion unit configured to generate a propulsion force of the ship; and a steering actuator, wherein the ship includes an operation unit configured to operate the propulsion unit and the steering actuator, wherein the operation unit is able to be positioned at least at a first position that is a position where the plurality of ship propulsion devices do not generate propulsion forces for the ship and a second position that is a position where the plurality of ship propulsion devices generate propulsion forces for moving the ship in a right direction, a right-forward direction, or a right-backward direction or a third position that is a position where the plurality of ship propulsion devices generate propulsion forces for moving the ship in a left direction, a left-forward direction, or a left-backward direction, wherein, when the operation unit is moved from the first position to the second position and maintained at the second position, the ship propulsion device controller causes the plurality of ship propulsion devices to generate a first rotating moment that is a rotating moment in a direction in which a front portion of the hull relatively moves to the right with respect to the rear portion in the ship during a first period from a first timing when the operation unit is moved to the second position to a second timing and subsequently does not cause the plurality of ship propulsion devices to generate the first rotating moment in the ship during a second period after the second timing, and wherein, when the operation unit is moved from the first position to the third position and maintained at the third position, the ship propulsion device controller causes the plurality of ship propulsion devices to generate a second rotating moment that is a rotating moment in a direction in which the front portion of the hull relatively moves to the left with respect to the rear portion in the ship during a third period from a third timing when the operation unit is moved to the third position to a fourth timing and subsequently does not cause the plurality of ship propulsion devices to generate the second rotating moment in the ship during a fourth period after the fourth timing.

According to an aspect of the present invention, there is provided a ship propulsion device control method of controlling a plurality of ship propulsion devices disposed on a rear portion of a hull of a ship, wherein each of the plurality of ship propulsion devices includes a propulsion unit configured to generate a propulsion force of the ship; and a steering actuator, wherein the ship includes an operation unit configured to operate the propulsion unit and the steering actuator; and a ship propulsion device controller configured to control the plurality of ship propulsion devices, wherein the operation unit is able to be positioned at least at a first position that is a position where the plurality of ship propulsion devices do not generate propulsion forces for the ship and a second position that is a position where the plurality of ship propulsion devices generate propulsion forces for moving the ship in a right direction, a right-forward direction, or a right-backward direction or a third position that is a position where the plurality of ship propulsion devices generate propulsion forces for moving the ship in a left direction, a left-forward direction, or a left-backward direction, wherein, when the operation unit is moved from the first position to the second position and maintained at the second position, the ship propulsion device controller causes the plurality of ship propulsion devices to generate a first rotating moment that is a rotating moment in a direction in which a front portion of the hull relatively moves to the right with respect to the rear portion in the ship during a first period from a first timing when the operation unit is moved to the second position to a second timing and subsequently does not cause the plurality of ship propulsion devices to generate the first rotating moment in the ship during a second period after the second timing, and wherein, when the operation unit is moved from the first position to the third position and maintained at the third position, the ship propulsion device controller causes the plurality of ship propulsion devices to generate a second rotating moment that is a rotating moment in a direction in which the front portion of the hull relatively moves to the left with respect to the rear portion in the ship during a third period from a third timing when the operation unit is moved to the third position to a fourth timing and subsequently does not cause the plurality of ship propulsion devices to generate the second rotating moment in the ship during a fourth period after the fourth timing.

According to an aspect of the present invention, there is provided a program for controlling a plurality of ship propulsion devices disposed on a rear portion of a hull of a ship, wherein each of the plurality of ship propulsion devices includes a propulsion unit configured to generate a propulsion force of the ship; and a steering actuator, wherein the ship includes an operation unit configured to operate the propulsion unit and the steering actuator, wherein the operation unit is able to be positioned at least at a first position that is a position where the plurality of ship propulsion devices do not generate propulsion forces for the ship and a second position that is a position where the plurality of ship propulsion devices generate propulsion forces for moving the ship in a right direction, a right-forward direction, or a right-backward direction or a third position that is a position where the plurality of ship propulsion devices generate propulsion forces for moving the ship in a left direction, a left-forward direction, or a left-backward direction, wherein, when the operation unit is moved from the first position to the second position and maintained at the second position, the program causes a computer to execute a first step in which the plurality of ship propulsion devices are allowed to generate a first rotating moment that is a rotating moment in a direction in which a front portion of the hull relatively moves to the right with respect to the rear portion in the ship during a first period from a first timing when the operation unit is moved to the second position to a second timing and a second step in which the plurality of ship propulsion devices are not allowed to generate the first rotating moment in the ship during a second period after the second timing, and wherein, when the operation unit is moved from the first position to the third position and maintained at the third position, the program causes the computer to execute a third step in which the plurality of ship propulsion devices are allowed to generate a second rotating moment that is a rotating moment in a direction in which the front portion of the hull relatively moves to the left with respect to the rear portion in the ship during a third period from a third timing when the operation unit is moved to the third position to a fourth timing and a fourth step in which the plurality of ship propulsion devices are not allowed to generate the second rotating moment in the ship during a fourth period after the fourth timing.

Advantageous Effects of Invention

According to the present invention, it is possible to provide a ship propulsion device controller, a ship propulsion device control method, and a program capable of restricting a ship from turning due to the start of a movement of a front portion of a hull being later than the start of a movement of a rear portion of the hull when the ship, which is stopped, is moved.

DESCRIPTION OF EMBODIMENTS

First Embodiment

Hereinafter, a first embodiment of a ship propulsion device controller, a ship propulsion device control method, and a program of the present invention will be described.

Figure 1:
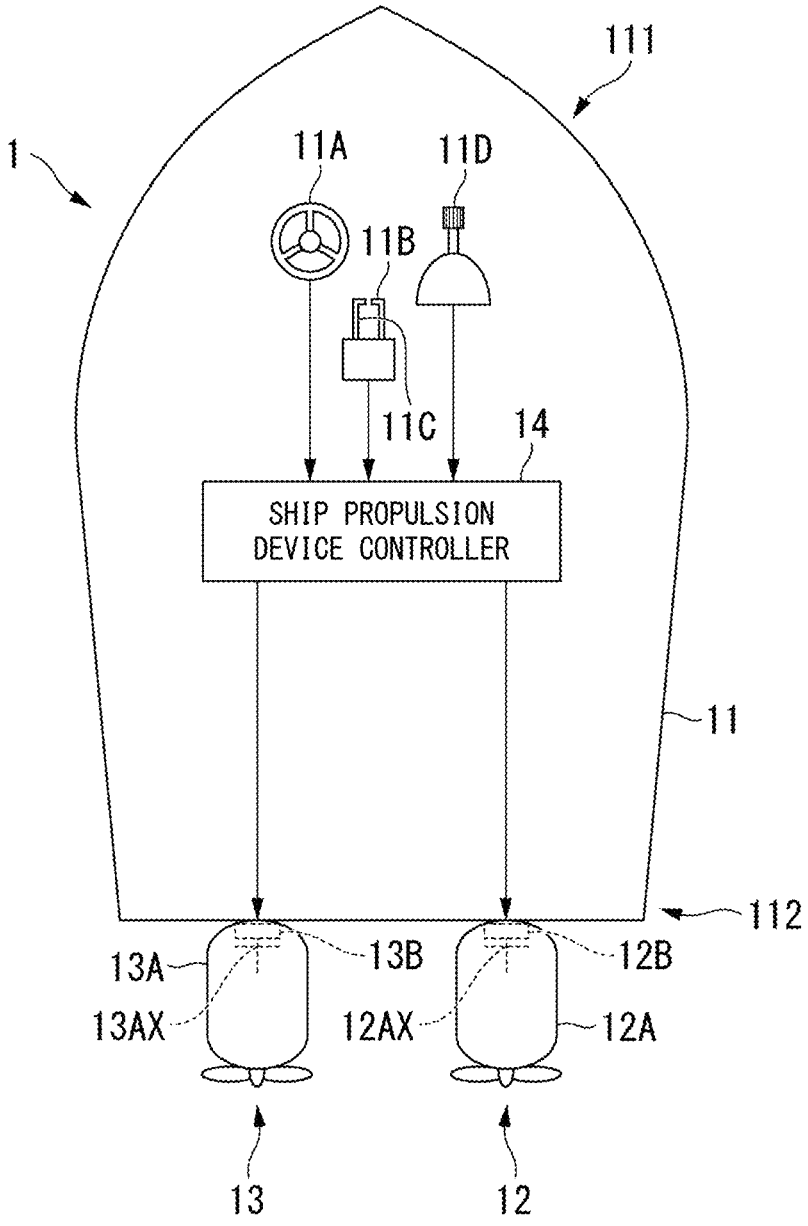
FIG. 1 is a diagram showing an example of a ship to which a ship propulsion device controller of a first embodiment is applied.
Figure 2:
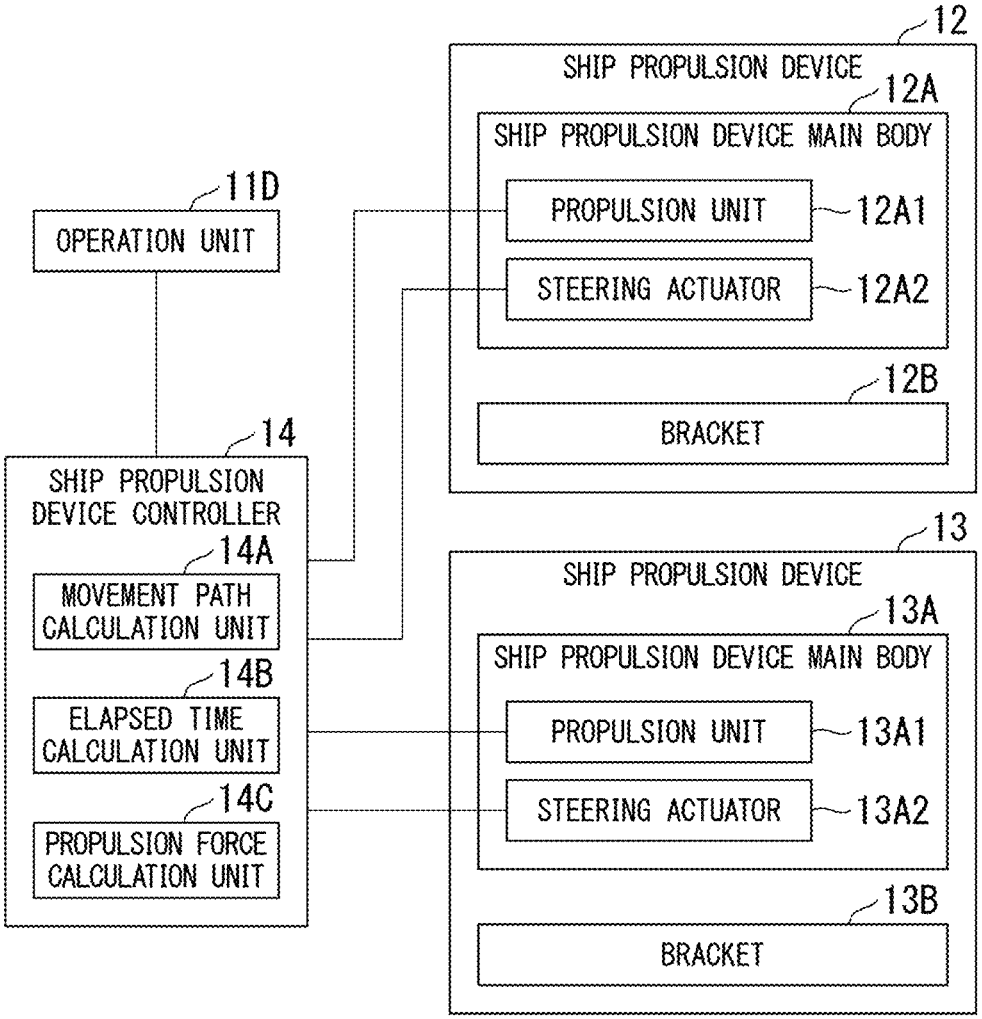
FIG. 2 is a functional block diagram of main parts of the ship shown in FIG. 1.

FIG. 1 is a diagram showing an example of a ship 1 to which a ship propulsion device controller 14 of the first embodiment is applied. FIG. 2 is a functional block diagram of main parts of the ship 1 shown in FIG. 1.

In the example shown in FIG. 1 and FIG. 2, the ship 1 includes a hull 11, a ship propulsion device 12, a ship propulsion device 13, and the ship propulsion device controller 14. The ship propulsion devices 12 and 13 generate propulsion forces for the ship 1.

In the examples shown in FIG. 1 and FIG. 2, the ship propulsion device 12 is disposed on a right part of the rear portion 112 of the hull 11. The ship propulsion device 12 includes a ship propulsion device main body 12A and a bracket 12B. The bracket 12B is a mechanism for attaching the ship propulsion device 12 to the right part of the rear portion 112 of the hull 11. The ship propulsion device main body 12A is connected to the right part of the rear portion 112 of the hull 11 via the bracket 12B rotatably with respect to the hull 11 around a steering shaft 12AX.

The ship propulsion device main body 12A includes a propulsion unit 12A1 and a steering actuator 12A2. The propulsion unit 12A1 generates a propulsion force for the ship 1. The steering actuator 12A2 causes the entire ship propulsion device main body 12A including the propulsion unit 12A1 to rotate with respect to the hull 11 around the steering shaft 12AX. The steering actuator 12A2 serves as a rudder.

In the examples shown in FIG. 1 and FIG. 2, the ship propulsion device 13 is disposed on a left part of the rear portion 112 of the hull 11. The ship propulsion device 13 includes a ship propulsion device main body 13A and a bracket 13B. The bracket 13B is a mechanism for attaching the ship propulsion device 13 to the left part of the rear portion 112 of the hull 11. The ship propulsion device main body 13A is connected to the left part of the rear portion 112 of the hull 11 via the bracket 13B rotatably with respect to the hull 11 around a steering shaft 13AX.

The ship propulsion device main body 13A includes a propulsion unit 13A1 and a steering actuator 13A2. The propulsion unit 13A1 generates a propulsion force for the ship 1 like the propulsion unit 12A1. The steering actuator 13A2 causes the entire ship propulsion device main body 13A including the propulsion unit 13A1 to rotate with respect to the hull 11 around the steering shaft 13AX. The steering actuator 13A2 serves as a rudder.

In the examples shown in FIG. 1 and FIG. 2, the ship propulsion devices 12 and 13 are outboard motors having propeller-specification propulsion units 12A1 and 13A1 driven by, for example, an engine (not shown). In another example, each of the ship propulsion devices 12 and 13 may be an inboard motor having a propeller-specific propulsion unit, an inboard/outboard motor having a propeller-specification propulsion unit, a ship propulsion device having a water jet-specification propulsion unit, a pod drive type ship propulsion device, or the like.

In the example shown in FIG. 1 and FIG. 2, the hull 11 includes a steering device 11A, a remote control device 11B, a remote control device 11C, and an operation unit 11D.

In another example, the hull 11 may not include the steering device 11A, the remote control device 11B, and the remote control device IC.

In the example shown in FIG. 1 and FIG. 2, the steering device 11A is a device that operates the steering actuators 12A2 and 13A2, and is, for example, a steering device having a steering wheel. By operating the steering device 11A, the ship operator can operate the steering actuators 12A2 and 13A2 to steer the ship 1.

The remote control device 11B is a device that receives an input operation for operating the propulsion unit 12A1, and has, for example, a remote control lever. The ship operator can change a magnitude and a direction of the propulsion force generated by the propulsion unit 12A1 by operating the remote control device 11B. The remote control lever of the remote control device 11B can be positioned in a forward movement region where the propulsion unit 12A1 generates a forward propulsion force for the ship 1, a backward movement region where the propulsion unit 12A1 generates a backward propulsion force for the ship 1, and a neutral region where the propulsion unit 12A1 does not generate a propulsion force. A magnitude of the forward propulsion force for the ship 1 generated by the propulsion unit 12A1 changes in accordance with the position of the remote control lever within the forward movement region. Also, a magnitude of the backward propulsion force for the ship 1 generated by the propulsion unit 12A1 changes in accordance with the position of the remote control lever within the backward movement region.

In the examples shown in FIG. 1 and FIG. 2, the remote control device 11C is a device that receives an input operation for operating the propulsion unit 13A1, and is configured like the remote control device 11B. That is, the ship operator can change a magnitude and a direction of the propulsion force generated by the propulsion unit 13A1 by operating the remote control device 11C.

The operation unit 11D is a device that operates the propulsion units 12A1 and 13A1 and the steering actuators 12A2 and 13A2. Specifically, the operation unit 11D receives an input operation for operating the propulsion units 12A1 and 13A1 and the steering actuators 12A2 and 13A2. The operation unit 11D is provided separately from the steering device 11A and the remote control devices 11B and 11C.

In the ship 1 of the first embodiment, the operation unit 11D includes a joystick having a lever.

The ship operator can not only operate the propulsion units 12A1 and 13A1 and the steering actuators 12A2 and 13A2 by operating the steering device 11A (the steering wheel) and the remote control devices 11B and 11C (the remote control levers), but also operate the propulsion units 12A1 and 13A1 and the steering actuators 12A2 and 13A2 by operating the operation unit 11D (the joystick).

In the example shown in FIG. 1 and FIG. 2, the ship propulsion device controller 14 controls the propulsion unit 12A1 and the steering actuator 12A2 of the ship propulsion device 12 and the propulsion unit 13A1 and the steering actuator 13A2 of the ship propulsion device 13 on the basis of an input operation on the operation unit 11D. Specifically, the ship propulsion device controller 14 controls magnitudes and directions of the propulsion forces for the ship 1 generated by the propulsion units 12A1 and 13A1 and the steering actuators 12A2 and 13A2 on the basis of an input operation on the operation unit 11D.

A rotating moment may be generated in the ship 1 in accordance with the magnitudes and the directions of the propulsion forces generated by the propulsion units 12A1 and 13A1 and the steering actuators 12A2 and 13A2. That is, the ship propulsion device controller 14 also controls a magnitude and a direction of the rotating moment generated in the ship 1 by the propulsion units 12A1 and 13A1 and the steering actuators 12A2 and 13A2 on the basis of an input operation on the operation unit 11D.

In the examples shown in FIG. 1 and FIG. 2, the ship propulsion device controller 14 includes a movement path calculation unit 14A, an elapsed time calculation unit 14B, and a propulsion force calculation unit 14C. The movement path calculation unit 14A calculates a movement path of the operation unit 11D. Specifically, the movement path calculation unit 14A calculates a movement path of the tip of the lever of the joystick on the basis of a position of the lever of the joystick detected by a sensor (not shown) such as, for example, a microswitch.

The elapsed time calculation unit 14B calculates an elapsed time period from a timing when the operation unit 11D (the tip of the lever of the joystick) has been moved to a certain position.

The propulsion force calculation unit 14C calculates propulsion forces that are generated by the ship propulsion devices 12 and 13 on the basis of the movement path of the operation unit 11D calculated by the movement path calculation unit 14A and the elapsed time period calculated by the elapsed time calculation unit 14B. Specifically, the propulsion force calculation unit 14C calculates magnitudes and directions of propulsion forces for the ship 1 generated by the propulsion units 12A1 and 13A1 and the steering actuators 12A2 and 13A2 on the basis of the movement path of the tip of the lever of the joystick and the time period (the elapsed time period) during which the tip of the lever of the joystick is continuously positioned at the certain position.

Also, the propulsion force calculation unit 14C calculates the rotating moment generated by the ship propulsion devices 12 and 13 in the ship 1 on the basis of the movement path of the operation unit 11D calculated by the movement path calculation unit 14A and the elapsed time period calculated by the elapsed time calculation unit 14B. Specifically, the propulsion force calculation unit 14C calculates a magnitude and a direction of a rotating moment of the ship 1 generated by the propulsion units 12A1 and 13A1 and the steering actuators 12A2 and 13A2 on the basis of the movement path of the tip of the lever of the joystick and the time period (the elapsed time period) during which the tip of the lever of the joystick is continuously positioned at the certain position.

That is, the ship propulsion device controller 14 controls the propulsion units 12A1 and 13A1 and the steering actuators 12A2 and 13A2 so that the propulsion units 12A1 and 13A1 and the steering actuators 12A2 and 13A2 generate the propulsion forces and/or the rotating moment of the magnitudes and directions calculated by the propulsion force calculation unit 14C.

In the examples shown in FIG. 1 and FIG. 2, the operation unit 11D is configured so that the lever of the operation unit 11D (the joystick) can be tilted and the lever can rotate about the central axis of the lever.

When the ship operator rotates the lever clockwise around the central axis of the lever, the ship propulsion device controller 14 controls the propulsion units 12A1 and 13A1 and the steering actuators 12A2 and 13A2 so that the hull 11 turns to the right (i.e., the head of the hull 11 turns clockwise on the spot and the front portion 111 of the hull 11 relatively moves to the right with respect to the rear portion 112). On the other hand, when the ship operator rotates the lever counterclockwise around the central axis of the lever, the ship propulsion device controller 14 controls the propulsion units 12A1 and 13A1 and the steering actuators 12A2 and 13A2 so that the hull 11 turns to the left (i.e., the head of the hull 11 turns counterclockwise on the spot and the front portion 111 of the hull 11 relatively moves to the left with respect to the rear portion 112). That is, the ship operator rotates the lever around the central axis of the lever, so that the direction of the front portion 111 of the hull 11 changes.

Also, as will be described in detail below, when the ship operator tilts the lever, the ship propulsion device controller 14 controls the propulsion units 12A1 and 13A1 and the steering actuators 12A2 and 13A2 so that the hull 11 moves while maintaining an attitude. That is, the ship operator tilts the lever, so that the front portion 111 of the hull 11 and the rear portion 112 of the hull 11 perform a translational movement.

FIG. 3A to FIG. 3I are diagrams for describing an example of positions of the operation unit 11D (specifically, positions P1 to P9 of the tip of the lever of the joystick) in the ship 1 of the first embodiment.

Figures 3A, 3B, 3C, 3D, 3E, 3F, 3G, 3H, 3I:
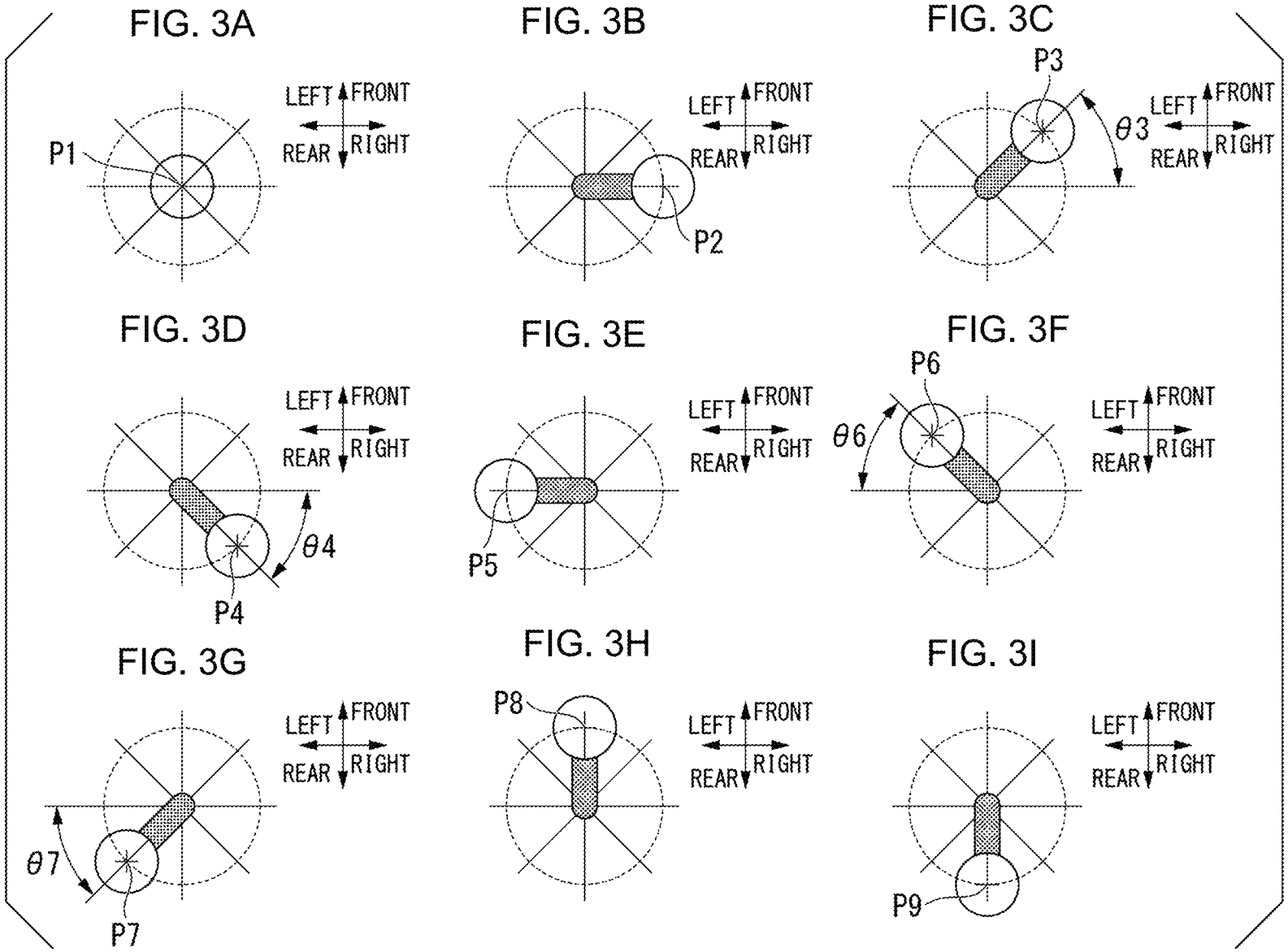
FIG. 3A to FIG. 3I is a diagram for describing an example of a position of an operation unit (specifically, a position of a tip of a lever of a joystick) in the ship of the first embodiment.

In the example shown in FIG. 3A, the lever of the operation unit 11D (the joystick) is not tilted. Therefore, the operation unit 11D (specifically, the tip of the lever of the joystick) is positioned at a position (a neutral position) P1. When the operation unit 11D (the tip of the lever of the joystick) is positioned at the position P1, the ship propulsion device controller 14 does not cause the propulsion units 12A1 and 13A1 and the steering actuators 12A2 and 13A2 to generate the propulsion forces for the ship 1.

That is, the position P1 is a position where the ship propulsion devices 12 and 13 do not generate the propulsion forces for the ship 1.

In the example shown in FIG. 3B, the lever of the joystick is tilted to the right. Thus, the tip of the lever of the joystick is positioned at the position P2 on the right side of the position P1. When the tip of the lever of the joystick is positioned at the position P2, the ship propulsion device controller 14 causes the propulsion units 12A1 and 13A1 and the steering actuators 12A2 and 13A2 to generate propulsion forces for moving the ship 1 to the right.

That is, the position P2 is a position where the ship propulsion devices 12 and 13 generate propulsion forces for moving the ship 1 to the right (specifically, a translational movement).

As will be described in detail below, the ship propulsion devices 12 and 13 not only generate propulsion forces for moving the ship 1 in the right direction, but also generate a rotating moment for turning the hull 11 to the right (i.e., turning the hull 11 clockwise) in the ship 1 so that the ship 1 is allowed to perform a translational movement in the right direction.

In the example shown in FIG. 3C, the lever of the joystick is tilted in the right-forward direction. Thus, the tip of the lever of the joystick is positioned at the position P3 on the right front side of the position P1. When the tip of the lever of the joystick is positioned at the position P3, the ship propulsion device controller 14 causes the propulsion units 12A1 and 13A1 and the steering actuators 12A2 and 13A2 to generate propulsion forces for moving the ship 1 in a right-forward direction forming an acute angle θ3 with respect to a left-to-right direction.

That is, the position P3 is a position where the ship propulsion devices 12 and 13 generate propulsion forces for moving the ship 1 in the right-forward direction (a translational movement).

As will be described in detail below, the ship propulsion devices 12 and 13 not only generate propulsion forces for moving the ship 1 in the right-forward direction, but also generate a rotating moment for turning the hull 11 to the right (i.e., turning the hull 11 clockwise) in the ship 1, so that the ship 1 is allowed to perform a translational movement in the right-forward direction.

In the example shown in FIG. 3D, the lever of the joystick is tilted in the right-backward direction. Thus, the tip of the lever of the joystick is positioned at the position P4 on the right rear side of the position P1. When the tip of the lever of the joystick is positioned at the position P4, the ship propulsion device controller 14 causes the propulsion units 12A1 and 13A1 and the steering actuators 12A2 and 13A2 to generate propulsion forces for moving the ship 1 in a right-backward direction forming an acute angle θ4 with respect to the left-to-right direction.

That is, the position P4 is a position where the ship propulsion devices 12 and 13 generate a propulsion force for moving the ship 1 in the right-backward direction (a translational movement).

As will be described in detail below, the ship propulsion devices 12 and 13 not only generate propulsion forces for moving the ship 1 in the right-backward direction, but also generate a rotating moment for turning the hull 11 to the right (i.e., turning the hull 11 clockwise) in the ship 1 so that the ship 1 is allowed to perform a translational movement in the right-backward direction.

In the example shown in FIG. 3E, the lever of the joystick is tilted to the left. Thus, the tip of the lever of the joystick is positioned at the position P5 on the left side of the position P1. When the tip of the lever of the joystick is positioned at the position P5, the ship propulsion device controller 14 causes the propulsion units 12A1 and 13A1 and the steering actuators 12A2 and 13A2 to generate propulsion forces for moving the ship 1 to the left.

That is, the position P5 is a position where the ship propulsion devices 12 and 13 generate propulsion forces for moving the ship 1 to the left (a translational movement).

As will be described in detail below, the ship propulsion devices 12 and 13 not only generate propulsion forces for moving the ship 1 in the left direction, but also generate a rotating moment for turning the hull 11 to the left (i.e., turning the hull 11 counterclockwise) in the ship 1 so that the ship 1 is allowed to perform a translational movement in the left direction.

In the example shown in FIG. 3F, the lever of the joystick is tilted in a left-forward direction. Thus, the tip of the lever of the joystick is positioned at the position P6 on the left front side of the position P1. When the tip of the lever of the joystick is positioned at the position P6, the ship propulsion device controller 14 causes the propulsion units 12A1 and 13A1 and the steering actuators 12A2 and 13A2 to generate propulsion forces for moving the ship 1 in a left-forward direction forming an acute angle θ6 with respect to the left-to-right direction.

That is, the position P6 is a position where the ship propulsion devices 12 and 13 generate propulsion forces for moving the ship 1 in the left-forward direction (a translational movement).

As will be described in detail below, the ship propulsion devices 12 and 13 not only generate propulsion forces for moving the ship 1 in the left-forward direction, but also generate a rotating moment for turning the hull 11 to the left (i.e., turning the hull 11 counterclockwise) in the ship 1 so that the ship 1 is allowed to perform a translational movement in the left-forward direction.

In the example shown in FIG. 3G, the lever of the joystick is tilted in the left-backward direction. Thus, the tip of the lever of the joystick is positioned at the position P7 on the left rear side of the position P1. When the tip of the lever of the joystick is positioned at the position P7, the ship propulsion device controller 14 causes the propulsion units 12A1 and 13A1 and the steering actuators 12A2 and 13A2 to generate propulsion forces for moving the ship 1 in a left-backward direction forming an acute angle θ7 with respect to the left-to-right direction.

That is, the position P7 is a position where the ship propulsion devices 12 and 13 generate propulsion forces for moving the ship 1 in the left-backward direction (a translational movement).

As will be described in detail below, the ship propulsion devices 12 and 13 not only generate propulsion forces for moving the ship 1 in the left-backward direction, but also generate a rotating moment for turning the hull 11 to the left (i.e., turning the hull 11 counterclockwise) in the ship 1 so that the ship 1 is allowed to perform a translational movement in the left-backward direction.

In the example shown in FIG. 3H, the lever of the joystick is tilted forward. Thus, the tip of the lever of the joystick is positioned at the position P8 on the front side of the position P1. When the tip of the lever of the joystick is positioned at the position P8, the ship propulsion device controller 14 causes the propulsion units 12A1 and 13A1 and the steering actuators 12A2 and 13A2 to generate propulsion forces for moving the ship 1 forward.

That is, the position P8 is a position where the ship propulsion devices 12 and 13 generate propulsion forces for moving (advancing) the ship 1 forward.

In the example shown in FIG. 3I, the lever of the joystick is tilted backward. Thus, the tip of the lever of the joystick is positioned at the position P9 on the rear side of the position P1. When the tip of the lever of the joystick is positioned at the position P9, the ship propulsion device controller 14 causes the propulsion units 12A1 and 13A1 and the steering actuators 12A2 and 13A2 to generate propulsion forces for moving the ship 1 backward.

That is, the position P9 is a position where the ship propulsion devices 12 and 13 generate propulsion forces for moving (reversing) the ship 1 backward.

When the ship operator does not operate the operation unit 11D (the joystick), the tip of the lever of the joystick having an automatic return function is positioned at the position P1. The tip of the lever of the joystick can be positioned at positions such as the positions P1 to P9 in accordance with an operation of the ship operator.

Figure 4A:
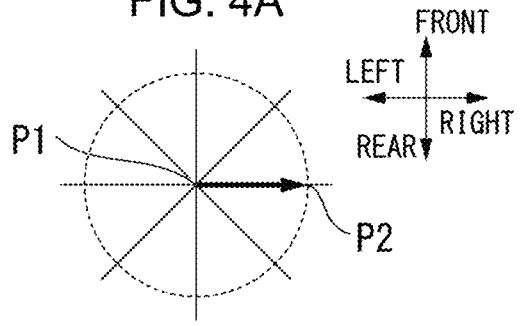
FIG. 4A and FIG. 4B are diagrams for describing an example of a movement path of the operation unit (specifically, a movement path of the tip of the lever of the joystick) in the ship of the first embodiment.
Figure 4B:
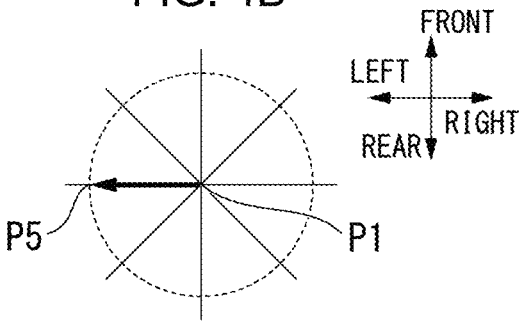

FIG. 4A and FIG. 4B are diagrams for describing an example of the movement path of the operation unit 11D (specifically, the movement path of the tip of the lever of the joystick) in the ship 1 of the first embodiment.

In the example shown in FIG. 4A, the operation unit 11D (specifically, the tip of the lever of the joystick) is moved from the position P1 to the position P2 and maintained at the position P2.

The movement path calculation unit 14A calculates a movement path P1→P2 of the tip of the lever of the joystick on the basis of a position of the lever at a timing when the tip of the lever of the joystick is positioned at the position P1 and a position of the lever at a timing when the tip of the lever of the joystick is positioned at the position P2.

The elapsed time calculation unit 14B calculates an elapsed time period from time t1 (see FIG. 5A to FIG. 5E) when the tip of the lever of the joystick is moved from the position P1 to the position P2. Specifically, the elapsed time calculation unit 14B calculates a time period during which the tip of the lever of the joystick is continuously positioned at the position P2.

The propulsion force calculation unit 14C calculates rightward propulsion forces that are generated by the ship propulsion devices 12 and 13 on the basis of the movement path P1→P2 of the tip of the lever of the joystick calculated by the movement path calculation unit 14A and the elapsed time period calculated by the elapsed time calculation unit 14B (the time period during which the tip of the lever of the joystick is continuously positioned at the position P2). Specifically, the propulsion force calculation unit 14C calculates magnitudes of the propulsion forces for moving the ship 1 to the right.

Also, the propulsion force calculation unit 14C calculates a clockwise rotating moment that is generated by the ship propulsion devices 12 and 13 in the ship 1 on the basis of the movement path P1→P2 of the tip of the lever of the joystick calculated by the movement path calculation unit 14A and the elapsed time period calculated by the elapsed time calculation unit 14B (the time period during which the tip of the lever of the joystick is continuously positioned at the position P2). Specifically, the propulsion force calculation unit 14C calculates a magnitude of the rotating moment for turning the ship 1 clockwise (the rotating moment in the direction in which the front portion 111 of the hull 11 moves in the right direction with respect to the rear portion 112).

Figure 6A:
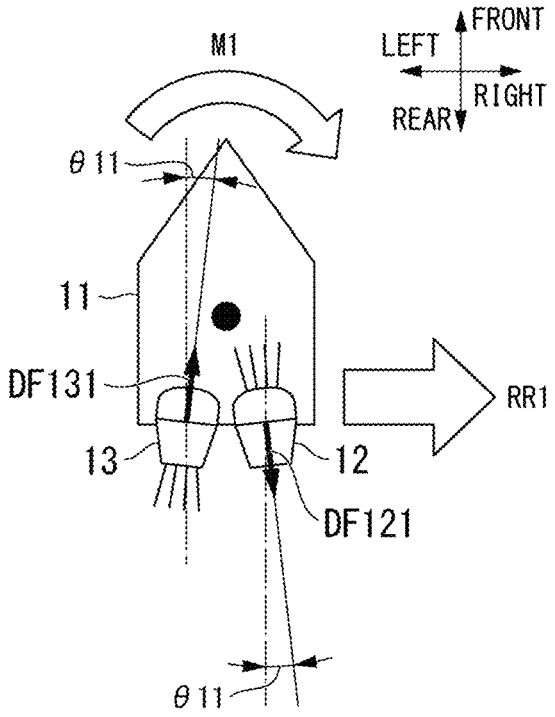
FIGS. 6A-FIG. 6B are diagrams for describing a direction of a rotating moment generated by the ship propulsion devices in the ship and the like when the operation unit is moved from the position P1 to the position P2 and maintained at the position P2.
Figure 6B:
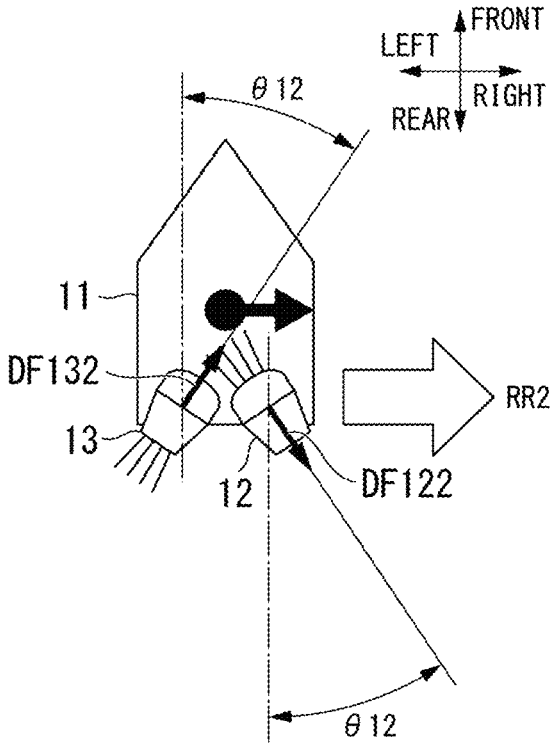
Figure 7A:
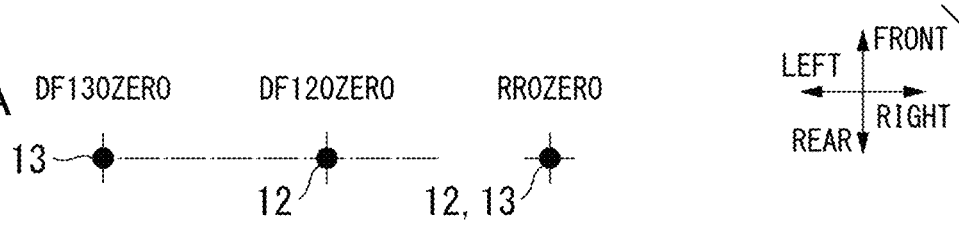
FIGS. 7A-FIG. 7C is a diagram for describing magnitudes and directions of propulsion forces generated by the ship propulsion devices and a magnitude and a direction of a resultant force thereof when the operation unit is moved from the position P1 to the position P2 and maintained at the position P2.
Figure 7B:
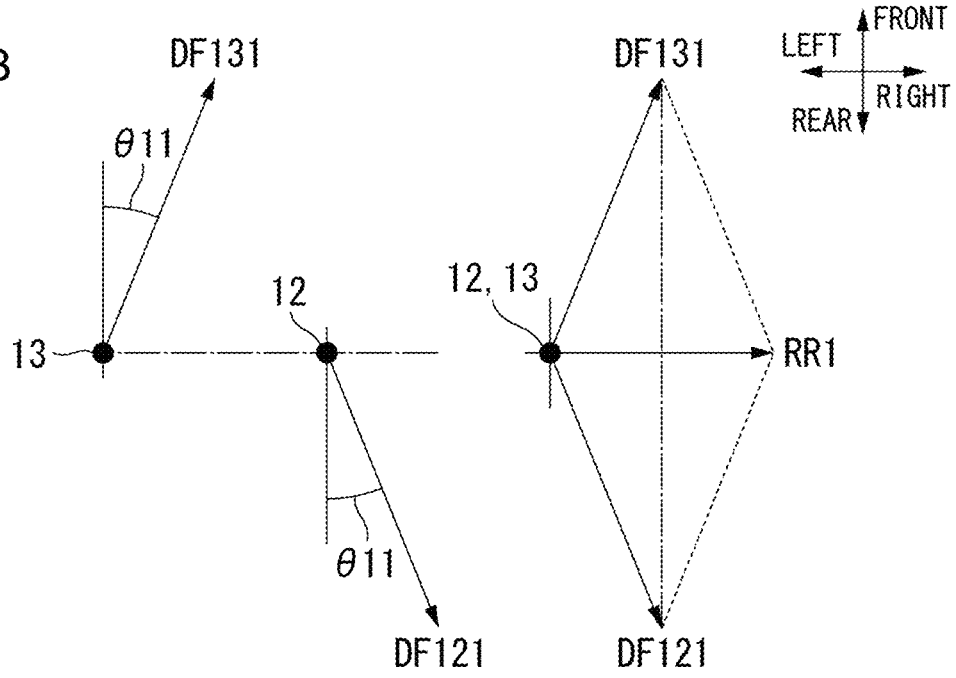
Figure 7C:
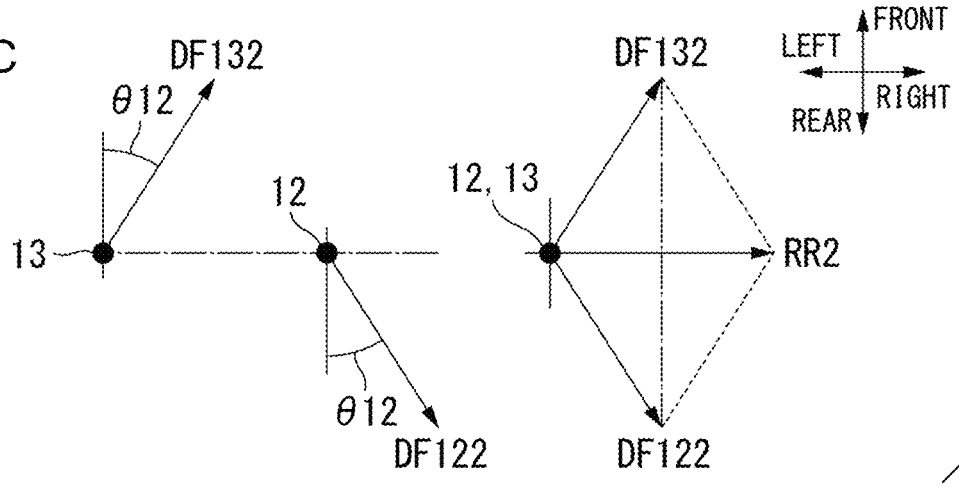

FIG. 5A to FIG. 5E are diagrams for describing a resultant force of propulsion forces generated by the ship propulsion devices 12 and 13 and the like when the operation unit 11D is moved from the position P1 to the position P2 and maintained at the position P2. FIGS. 6A-FIG. 6B are diagrams for describing a direction of a rotating moment generated by the ship propulsion devices 12 and 13 in the ship 1 when the operation unit 11D is moved from the position P1 to the position P2 and maintained at the position P2. FIGS. 7A-FIG. 7C are diagrams for describing magnitudes and directions of propulsion forces generated by the ship propulsion devices 12 and 13 when the operation unit 11D is moved from the position P1 to the position P2 and maintained at the position P2 and a magnitude and a direction of a resultant force thereof.

Figures 5A, 5B, 5C, 5D, 5E:
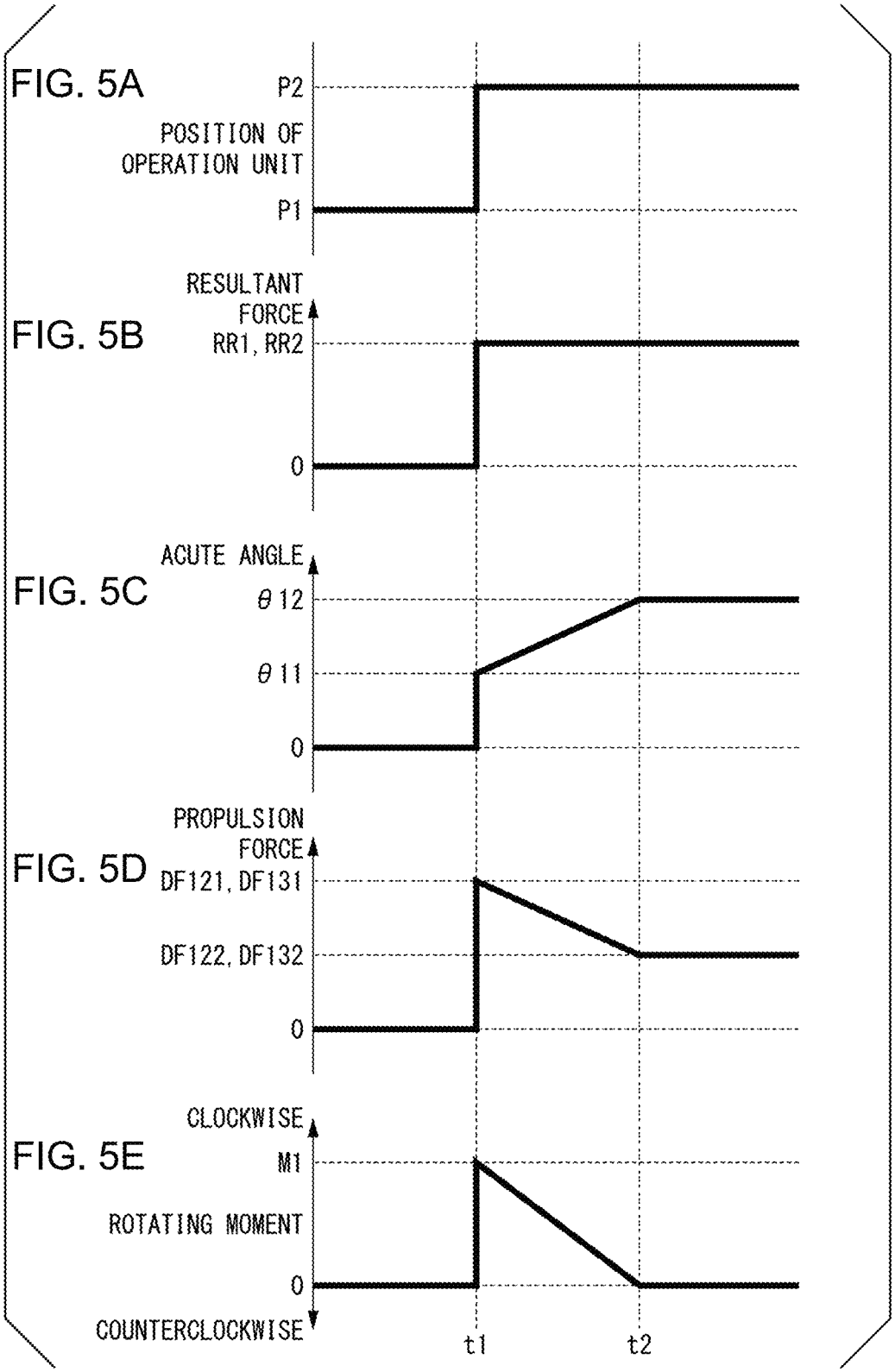
FIG. 5A to FIG. 5E are diagrams for describing a resultant force of propulsion forces generated by the ship propulsion devices and the like when the operation unit is moved from a position P1 to a position P2 and maintained at the position P2.

Specifically, FIG. 5A shows the positions P1 and P2 of the operation unit 11D during a period from a timing before time t1 to a timing after time t2, FIG. 5B shows a magnitude of a resultant force of the propulsion forces generated by the ship propulsion devices 12 and 13 during the period from the timing before time t1 to the timing after time t2, FIG. 5C shows acute angles formed by the propulsion forces generated by the ship propulsion devices 12 and 13 with respect to the front-to-rear direction of the ship 1 during the period from the timing before time t1 to the timing after time t2, FIG. 5D shows magnitudes of the propulsion forces generated by the ship propulsion devices 12 and 13 during the period from the timing before time t1 to the timing after time t2, and FIG. 5E shows a magnitude and a direction of a rotating moment generated by the ship propulsion devices 12 and 13 in the ship 1 during the period from the timing before time t1 to the timing after time t2.

FIG. 6A shows relationships between the hull 11 of the ship 1 and the ship propulsion devices 12 and 13 during the period from time t1 to time t2 and FIG. 6B shows relationships between the hull 11 of the ship 1 and the ship propulsion devices 12 and 13 during a period after time t2.

FIG. 7A show a magnitude and a direction of a propulsion force DF120 generated by the ship propulsion device 12, a magnitude and a direction of a propulsion force DF130 generated by the ship propulsion device 13, and a magnitude and a direction of a resultant force RR0 of the propulsion forces DF120 and DF130 generated by the ship propulsion devices 12 and 13 during a period before time 11. FIG. 7B shows a magnitude and a direction of a propulsion force DF121 generated by the ship propulsion device 12, a magnitude and a direction of a propulsion force DF131 generated by the ship propulsion device 13, and a magnitude and a direction of a resultant force RR1 of the propulsion forces DF121 and DF131 generated by the ship propulsion devices 12 and 13 during a period from time t1 to time t2. FIG. 7C shows a magnitude and a direction of a propulsion force DF122 generated by the ship propulsion device 12, a magnitude and a direction of a propulsion force DF132 generated by the ship propulsion device 13, and a magnitude and a direction of a resultant force RR2 of the propulsion forces DF122 and DF132 generated by the ship propulsion devices 12 and 13 during a period after time t2.

In the examples shown in FIG. 5A to FIG. 7C, as shown in FIG. 5A, the operation unit 11D is positioned at the position P1 during the period before time t1, the operation unit 11D is moved from the position P1 to the position P2 at time t1, and the operation unit 11D is maintained at the position P2 during the period after time t1.

During the period before time t1, as shown in FIG. 5D and FIG. 7A, the ship propulsion device 12 does not generate a propulsion force (i.e., a value of the propulsion force DF120 generated by the ship propulsion device 12 is zero) and the ship propulsion device 13 also does not generate a propulsion force (i.e., the value of the propulsion force DF130 generated by the ship propulsion device 13 is also zero). As a result, as shown in FIG. 5B and FIG. 7A, a value of the resultant force RR0 of the propulsion forces DF120 and DF130 generated by the ship propulsion devices 12 and 13 is also zero. Also, as shown in FIG. 5E, a value of a rotating moment generated by the ship propulsion devices 12 and 13 in the ship 1 are also zero.

Next, at time t1, as shown in FIG. 5D, FIG. 6A, and FIG. 7B, the ship propulsion device 12 generates a right-backward propulsion force DF121 of the ship 1. As shown in FIG. 5C, FIG. 6A, and FIG. 7B, the propulsion force DF121 generated by the ship propulsion device 12 forms an acute angle θ11 with respect to the front-to-rear direction (the vertical direction in FIGS. 6A-FIG. 6B and FIGS. 7A-FIG. 7C) of the ship 1.

Also, at time t1, as shown in FIG. 5D, FIG. 6A, and FIG. 7B, the ship propulsion device 13 generates a right-forward propulsion force DF131 of the ship 1. As shown in FIG. 5C, FIG. 6A, and FIG. 7B, the propulsion force DF131 generated by the ship propulsion device 13 forms an acute angle θ11 with respect to the front-to-rear direction of the ship 1.

As a result, at time t1, as shown in FIG. 5B and FIG. 7B, the ship propulsion devices 12 and 13 generate the resultant force RR1 of the rightward propulsion forces DF121 and DF131 of the ship 1.

Also, at time t1, as shown in FIG. 5E and FIG. 6A, the ship propulsion devices 12 and 13 generate a clockwise rotating moment M1 (a rotating moment M1 in a direction in which the front portion 111 of the hull 11 relatively moves to the right with respect to the rear portion 112) in the ship 1.

Although an acute angle θ11 formed by the propulsion force DF121 generated by the ship propulsion device 12 with respect to the front-to-rear direction of the ship 1 and an acute angle θ11 formed by the propulsion force DF131 generated by the ship propulsion device 13 with respect to the front-to-rear direction of the ship 1 are equal in the examples shown in FIG. 5A to FIG. 7C, an acute angle formed by the propulsion force DF121 generated by the ship propulsion device 12 with respect to the front-to-rear direction of the ship 1 and an acute angle formed by the propulsion force DF131 generated by the ship propulsion device 13 with respect to the front-to-rear direction of the ship 1 may be different in another example.

During the period from time t1 to time t2, as shown in FIG. 5D, the ship propulsion device 12 continuously generates the right-backward propulsion force for the ship 1. Specifically, the magnitude of the right-backward propulsion force for the ship 1 generated by the ship propulsion device 12 decreases linearly. As shown in FIG. 5C, the value of the acute angle formed by the propulsion force generated by the ship propulsion device 12 and the front-to-rear direction (the vertical direction in FIGS. 6A-FIG. 6B and FIGS. 7A-FIG.

C) of the ship 1 increases (for example, increases linearly) without decreasing on the way.

Also, during the period from time t1 to time t2, as shown in FIG. 5D, the ship propulsion device 13 continuously generates a right-forward propulsion force for the ship 1. Specifically, the magnitude of the right-forward propulsion force for the ship 1 generated by the ship propulsion device 13 decreases linearly. As shown in FIG. 5C, a value of an acute angle formed by the propulsion force generated by the ship propulsion device 13 and the front-to-rear direction of the ship 1 increases (for example, increases linearly) without decreasing on the way.

As a result, during the period from time t1 to time t2, as shown in FIG. 5B, a magnitude of a resultant force of the rightward propulsion forces for the ship 1 generated by the ship propulsion devices 12 and 13 is maintained at a value equal to a magnitude of the resultant force RR1.

Also, during the period from time t1 to time t2, as shown in FIG. 5E, a magnitude of a clockwise rotating moment generated by the ship propulsion devices 12 and 13 in the ship 1 (a rotating moment in a direction in which the front portion 111 of the hull 11 relatively moves to the right with respect to the rear portion 112) decreases linearly.

Although the magnitude of the resultant force of the rightward propulsion force for the ship 1 generated by the ship propulsion devices 12 and 13 is maintained at a constant value during the period from time t1 to time t2 in the example shown in FIGS. FIG. 5A to FIG. 7C, the magnitude of the resultant force of the rightward propulsion forces for the ship 1 generated by the ship propulsion devices 12 and 13 may not be maintained at a constant value during the period from time t1 to time t2 in another example.

Subsequently, at time t2, as shown in FIG. 5D, FIG. 6B, and (C) FIG. 7C, the right-backward propulsion force DF122 of the ship 1 generated by the ship propulsion device 12 forms an acute angle θ12 (>θ11) with respect to the front-to-rear direction of the ship 1 (the vertical direction in FIGS. 6 and 7).

Also, at time t2, as shown in FIG. 5D, FIG. 6B, and FIG. 7C, the right-forward propulsion force DF132 of the ship 1 generated by the ship propulsion device 13 forms an acute angle θ12 (>θ11) with respect to the front-to-rear direction of the ship 1.

As a result, at time t2, as shown in FIG. 5B and FIG. 7C, the ship propulsion devices 12 and 13 generate the resultant force RR2 of the rightward propulsion forces DF122 and DF132 of the ship 1. A magnitude of the resultant force RR2 is equal to the magnitude of the resultant force RR1.

Also, at time t2, as shown in FIG. 5E, the ship propulsion devices 12 and 13 do not generate a rotating moment in the ship 1. That is, the value of the rotating moment generated by the ship propulsion devices 12 and 13 in the ship 1 becomes zero.

Although an acute angle θ12 formed by the propulsion force DF122 of the ship 1 generated by the ship propulsion device 12 with respect to the front-to-rear direction of the ship 1 and an acute angle θ12 formed by the propulsion force DF132 of the ship 1 generated by the ship propulsion device 13 with respect to the front-to-rear direction of the ship 1 are equal in the examples shown in FIG. 5A- to FIG. 7C, an acute angle formed by the propulsion force DF122 generated by the ship propulsion device 12 with respect to the front-to-rear direction of the ship 1 and an acute angle formed by the propulsion force DF132 generated by the ship propulsion device 13 with respect to the front-to-rear direction of the ship 1 may be different in another example.

During the period after time t2, as shown in FIG. 5D, the ship propulsion device 12 continuously generates the right-backward propulsion force for the ship 1. The magnitude of the right-backward propulsion force for the ship 1 continuously generated by the ship propulsion device 12 is equal to the magnitude of the propulsion force DF122.

Also, during the period after time t2, as shown in FIG. 5D, the ship propulsion device 13 continuously generates the right-forward propulsion force for the ship 1. The magnitude of the right-forward propulsion force for the ship 1 continuously generated by the ship propulsion device 13 is equal to the magnitude of the propulsion force DF132.

As a result, during the period after time t2, as shown in FIG. 5B and FIG. 7C, the ship propulsion devices 12 and 13 continuously generate the resultant force of the rightward propulsion forces for the ship 1. The magnitude of the resultant force of the rightward propulsion forces for the ship 1 continuously generated by the ship propulsion devices 12 and 13 is equal to the magnitude of the resultant force RR2.

Also, during the period after time t2, as shown in FIG. 5E, the ship propulsion devices 12 and 13 do not generate a rotating moment in the ship 1. That is, the value of the rotating moment generated by the ship propulsion devices 12 and 13 in the ship 1 is maintained at zero.

Although the magnitude of the resultant force of the rightward propulsion forces for the ship 1 generated by the ship propulsion devices 12 and 13 is maintained at a constant value during the period after time t2 in the examples shown in FIG. 5A to FIG. 7C, the magnitude of the resultant force of the rightward propulsion forces for the ship 1 generated by the ship propulsion devices 12 and 13 may not be maintained at a constant value during the period after time t2 in another example.

That is, in the example shown in FIG. 5A to -FIG. 7C, during the period from time t1 to time t2 when the operation unit 11D is moved to the position P2, the ship propulsion device controller 14 causes the ship propulsion devices 12 and 13 to generate a rotating moment (a clockwise rotating moment) in a direction in which the front portion 111 of the hull 11 relatively moves to the right with respect to the rear portion 112 in the ship 1. Subsequently, during the period after time t2, the ship propulsion device controller 14 does not cause the ship propulsion devices 12 and 13 to generate a clockwise rotating moment in the ship 1.

Thus, in the examples shown in FIG. 5A to FIG. 7C, when the ship 1, which has been stopped, is moved to the right, it is possible to limit a possibility that the ship 1 will turn counterclockwise due to the start of a movement of the front portion 111 of the hull 11 being later than the start of a movement of the rear portion 112 of the hull 11 in the right direction.

Also, in the examples shown in FIG. 5A to FIG. 7C, during the period from time t1 to time t2, the ship propulsion device 12 generates a right-backward propulsion force forming an acute angle greater than or equal to the acute angle θ11 and less than the acute angle θ12 with respect to the front-to-rear direction of the ship 1 and the ship propulsion device 13 generates a right-forward propulsion force forming an acute angle greater than or equal to the acute angle θ11 and less than the acute angle θ12 with respect to the front-to-rear direction of the ship 1. Subsequently, during the period after time t2, the ship propulsion device 12 generates a right-backward propulsion force forming an acute angle θ12 (>θ11) with the front-to-rear direction of the ship 1 and the ship propulsion device 13 generates a right-forward propulsion force forming an acute angle θ12 (>θ11) with respect to the front-to-rear direction of the ship 1.

Specifically, in the examples shown in FIG. 5A to FIG. 7C, a value of the acute angle formed by the right-backward propulsion force generated by the ship propulsion device 12 with respect to the front-to-rear direction of the ship 1 during the period from time t1 to time t2 increases (for example, increases linearly) without decreasing on the way and a value of the acute angle formed by the right-forward propulsion force generated by the ship propulsion device 13 with respect to the front-to-rear direction of the ship 1 also increases (for example, increases linearly) without decreasing on the way.

Also, in the examples shown in FIG. 5A to FIG. 7C, a rightward resultant force of the right-backward propulsion force generated by the ship propulsion device 12 and the right-forward propulsion force generated by the ship propulsion device 13 during the period from time t1 to time t2 is equal to a rightward resultant force of the right-backward propulsion force generated by the ship propulsion device 12 and the right-forward propulsion force generated by the ship propulsion device 13 during the period after time t2 (i.e., magnitudes and directions of both propulsion forces are equal).

Thus, in the examples shown in FIG. 5A to FIG. 7C, the ship 1 can be quickly moved to the right during the period from time t1 to time t2, as in the period after time t2. That is, when the ship 1, which has been stopped, is moved to the right, it is possible to move the ship 1 quickly to the right while limiting a possibility that the start of a movement of the front portion 111 of the hull 11 will be later than the start of a movement of the rear portion 112 of the hull 11.

In the example in which the operation unit 11D (specifically, the tip of the lever of the joystick) is moved from the position P1 to the position P3 and maintained at the position P3, the movement path calculation unit 14A calculates a movement path P1→P3 of the tip of the lever of the joystick and the elapsed time calculation unit 14B calculates an elapsed time period from a timing when the tip of the lever of the joystick is moved from the position P1 to the position P3. The propulsion force calculation unit 14C calculates the magnitude of the propulsion force for moving the ship 1 in the right-forward direction. Also, the propulsion force calculation unit 14C calculates the clockwise rotating moment that is generated by the ship propulsion devices 12 and 13 in the ship 1.

In the example in which the operation unit 11D is moved from the position P1 to the position P3 and maintained at the position P3, the ship propulsion devices 12 and 13 generate a resultant force of the right-forward propulsion forces for the ship 1 during a period from a timing when the operation unit 11D is moved from the position P1 to the position P3 to a timing corresponding to time t2 in FIGS. 5A-FIG. 5E. Also, during the above period, the ship propulsion devices 12 and 13 generate a clockwise rotating moment in the ship 1.

Also, in the example in which the operation unit 11D is moved from the position P1 to the position P3 and maintained at the position P3, the ship propulsion devices 12 and 13 subsequently generate the resultant force of the right-forward propulsion forces for the ship 1 during a period after the timing corresponding to time t2 in FIG. 5. On the other hand, during the above period, the ship propulsion devices 12 and 13 do not generate a clockwise rotating moment in the ship 1.

In the example in which the operation unit 11D (specifically, the tip of the lever of the joystick) is moved from the position P1 to the position P4 and maintained at the position P4, the movement path calculation unit 14A calculates a movement path P1→P4 of the tip of the lever of the joystick and the elapsed time calculation unit 14B calculates an elapsed time period from a timing when the tip of the lever of the joystick is moved from the position P1 to the position P4. The propulsion force calculation unit 14C calculates a magnitude of the propulsion force for moving the ship 1 in the right-backward direction. Also, the propulsion force calculation unit 14C calculates the clockwise rotating moment that is generated by the ship propulsion devices 12 and 13 in the ship 1.

In the example in which the operation unit 11D is moved from the position P1 to the position P4 and maintained at the position P4, the ship propulsion devices 12 and 13 generate a resultant force of the right-backward propulsion forces for the ship 1 during a period from a timing when the operation unit 11D is moved from the position P1 to the position P4 to a timing corresponding to time t2 in FIG. 5A-FIG. 5E. Also, during the above period, the ship propulsion devices 12 and 13 generate a clockwise rotating moment in the ship 1.

Also, in the example in which the operation unit 11D is moved from the position P1 to the position P4 and maintained at the position P4, the ship propulsion devices 12 and 13 subsequently generate the resultant force of the right-backward propulsion forces for the ship 1 during a period after the timing corresponding to time t2 in FIG. 5A-FIG. 5E. On the other hand, during the above period, the ship propulsion devices 12 and 13 do not generate a clockwise rotating moment in the ship 1.

In the example shown in FIG. 4B, the operation unit 11D (specifically, the tip of the lever of the joystick) is moved from the position P1 to the position P5 and maintained at the position P5.

The movement path calculation unit 14A calculates a movement path P1→P5 of the tip of the lever of the joystick on the basis of a position of the lever at a timing when the tip of the lever of the joystick is positioned at the position P1 and a position of the lever at a timing when the tip of the lever of the joystick is positioned at the position P5.

The elapsed time calculation unit 14B calculates an elapsed time period from time t3 (see FIG. 8A-FIG. 8E) when the tip of the lever of the joystick is moved from the position P1 to the position P5. Specifically, the elapsed time calculation unit 14B calculates a time period during which the tip of the lever of the joystick is continuously positioned at the position P5.

The propulsion force calculation unit 14C calculates leftward propulsion forces that are generated by the ship propulsion devices 12 and 13 on the basis of the movement path P1→P5 of the tip of the lever of the joystick calculated by the movement path calculation unit 14A and the elapsed time period calculated by the elapsed time calculation unit 14B (the time period during which the tip of the lever of the joystick is continuously positioned at the position P5). Specifically, the propulsion force calculation unit 14C calculates magnitudes of the propulsion forces for moving the ship 1 to the left.

Also, the propulsion force calculation unit 14C calculates a counterclockwise rotating moment that is generated by the ship propulsion devices 12 and 13 in the ship 1 on the basis of the movement path P1→P5 of the tip of the lever of the joystick calculated by the movement path calculation unit 14A and the elapsed time period calculated by the elapsed time calculation unit 14B (the time period during which the tip of the lever of the joystick is continuously positioned at the position P5). Specifically, the propulsion force calculation unit 14C calculates a magnitude of the rotating moment for turning the ship 1 counterclockwise (the rotating moment in the direction in which the front portion 111 of the hull 11 relatively moves to the left with respect to the rear portion 112).

Figure 9A:
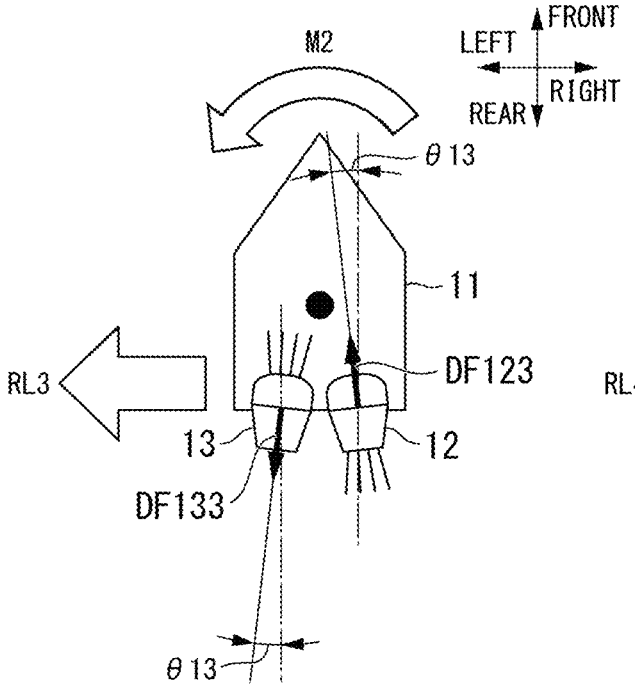
FIGS. 9A-FIG. 9B are diagrams for describing a direction of a rotating moment generated by the ship propulsion devices in the ship and the like when the operation unit is moved from the position P1 to the position P5 and maintained at the position P5.
Figure 9B:
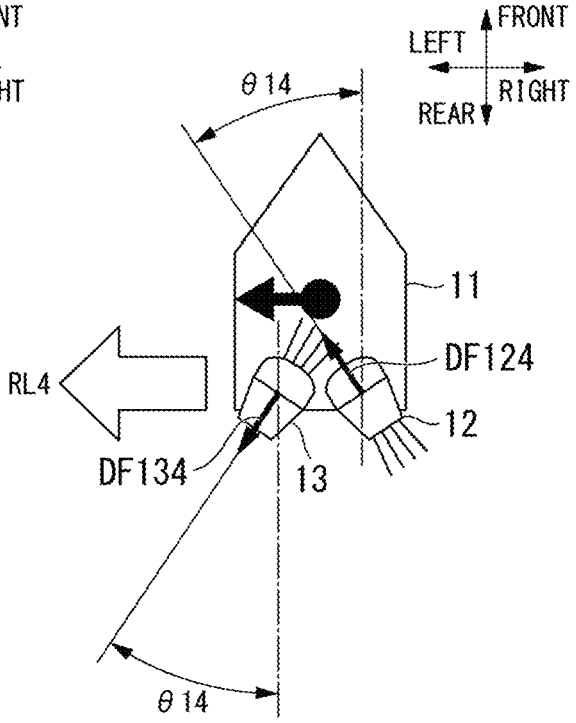
Figure 10A:
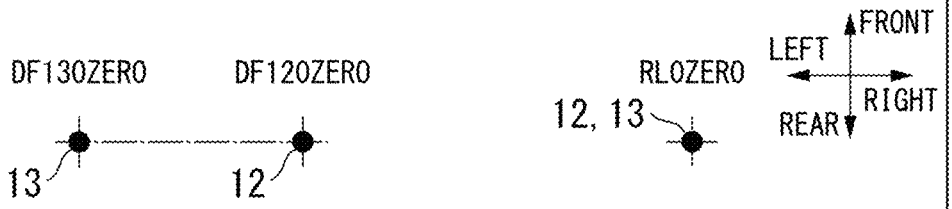
FIGS. 10A-FIG. 10C are diagrams for describing magnitudes and directions of propulsion forces generated by the ship propulsion devices and a magnitude and a direction of a resultant force thereof when the operation unit is moved from the position P1 to the position P5 and maintained at the position P5.
Figure 10B:
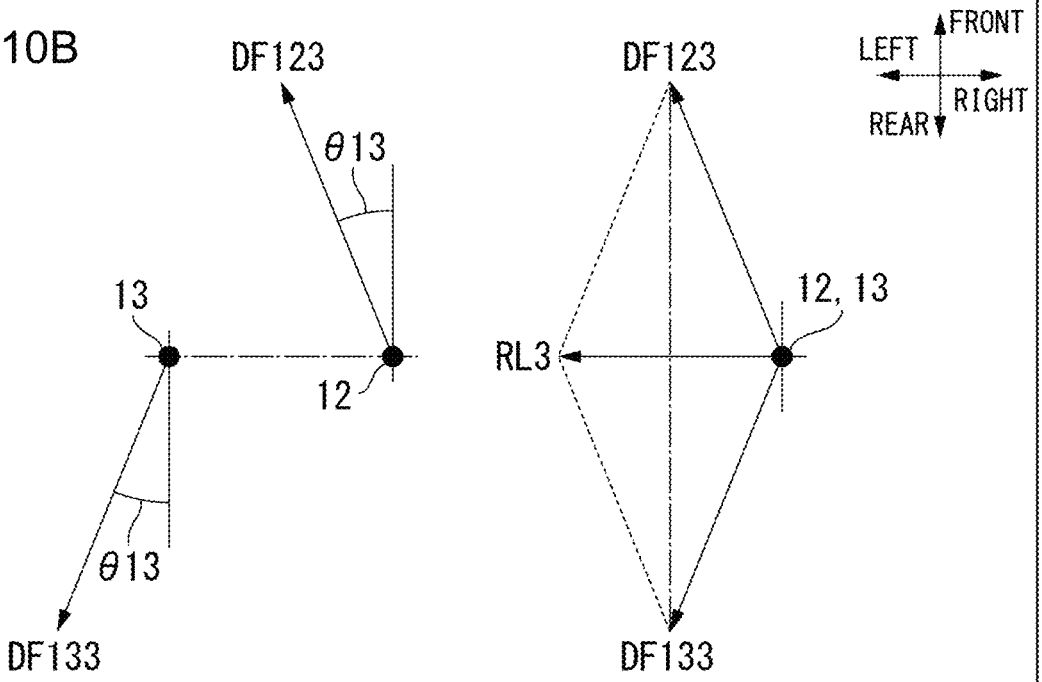
Figure 10C:
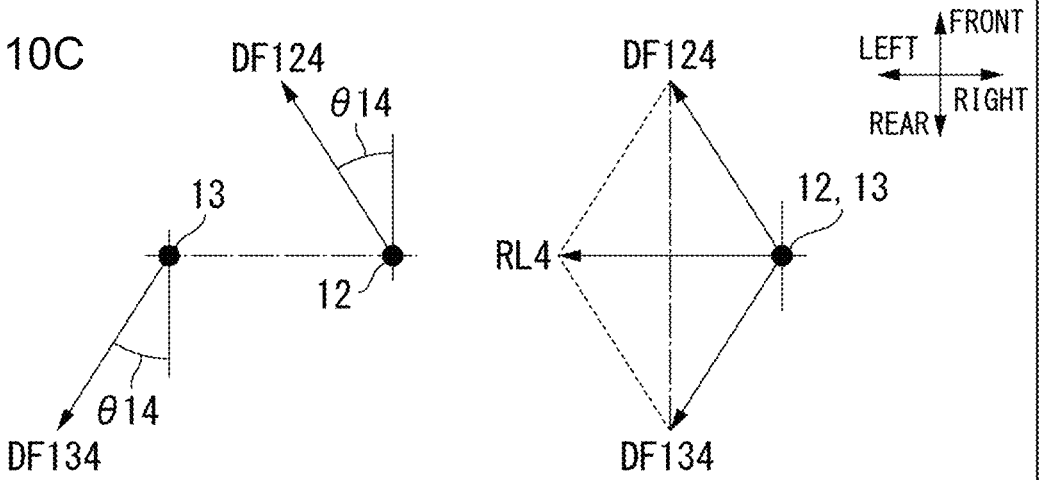

FIGS. 8A-FIG. 8E are diagrams for describing a resultant force of propulsion forces generated by the ship propulsion devices 12 and 13 and the like when the operation unit 11D is moved from the position P1 to the position P5 and maintained at the position P5. FIGS. 9A-FIG. 9B are diagrams for describing a direction of a rotating moment generated by the ship propulsion devices 12 and 13 in the ship 1 when the operation unit 11D is moved from the position P1 to the position P5 and maintained at the position P5. FIGS. 10A-FIG. 10C are diagrams for describing magnitudes and directions of propulsion forces generated by the ship propulsion devices 12 and 13 when the operation unit 11D is moved from the position P1 to the position P5 and maintained at the position P5 and a magnitude and a direction of a resultant force thereof.

Figures 8A, 8B, 8C, 8D, 8E:
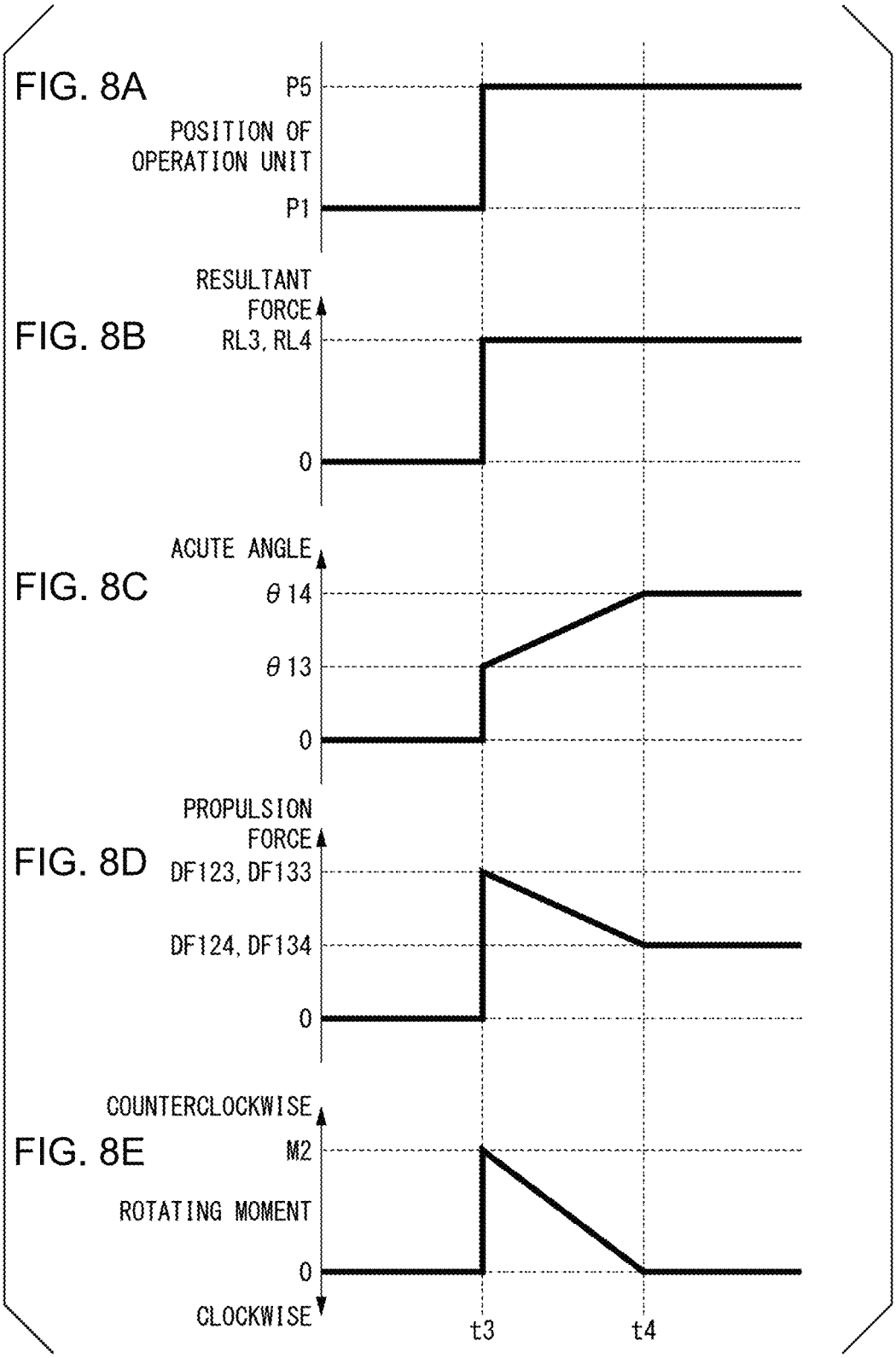
FIGS. 8A-FIG. 8E are diagrams for describing a resultant force of propulsion forces generated by the ship propulsion devices and the like when the operation unit is moved from the position P1 to a position P5 and maintained at the position P5.

Specifically, FIG. 8A shows the positions P1 and P5 of the operation unit 11D during a period from a timing before time t3 to a timing after time t4, FIG. 8B shows a magnitude of a resultant force of the propulsion forces generated by the ship propulsion devices 12 and 13 during the period from the timing before time t3 to the timing after time t4, FIG. 8C shows acute angles formed by the propulsion forces generated by the ship propulsion devices 12 and 13 with respect to the front-to-rear direction of the ship 1 during the period from the timing before time t3 to the timing after time t4, FIG. 8D shows magnitudes of the propulsion forces generated by the ship propulsion devices 12 and 13 during the period from the timing before time t3 to the timing after time t4, and FIG. 8E shows a magnitude and a direction of a rotating moment generated by the ship propulsion devices 12 and 13 in the ship 1 during the period from the timing before time t3 to the timing after time t4.

FIG. 9A shows relationships between the hull 11 of the ship 1 and the ship propulsion devices 12 and 13 during the period from time t3 to time t4 and FIG. 9B shows relationships between the hull 11 of the ship 1 and the ship propulsion devices 12 and 13 during a period after time t4.

FIG. 10A shows a magnitude and a direction of a propulsion force DF120 generated by the ship propulsion device 12, a magnitude and a direction of a propulsion force DF130 generated by the ship propulsion device 13, and a magnitude and a direction of a resultant force RL0 of the propulsion forces DF120 and DF130 generated by the ship propulsion devices 12 and 13 during a period before time t3. FIG. 10B shows a magnitude and a direction of a propulsion force DF123 generated by the ship propulsion device 12, a magnitude and a direction of a propulsion force DF133 generated by the ship propulsion device 13, and a magnitude and a direction of a resultant force RL3 of the propulsion forces DF123 and DF133 generated by the ship propulsion devices 12 and 13 during a period from time t3 to time t4. FIG. 10C shows a magnitude and a direction of a propulsion force DF124 generated by the ship propulsion device 12, a magnitude and a direction of a propulsion force DF134 generated by the ship propulsion device 13, and a magnitude and a direction of a resultant force RL4 of the propulsion forces DF124 and DF134 generated by the ship propulsion devices 12 and 13 during a period after time t4.

In the examples shown in FIGS. 8 to 10, as shown in FIG. 8A, the operation unit 11D is positioned at the position P1 during the period before time t3, the operation unit 11D is moved from the position P1 to the position P5 at time t3, and the operation unit 11D is maintained at the position P5 during the period after time t3.

During the period before time t3, as shown in FIG. 8D and FIG. 10A, the ship propulsion device 12 does not generate a propulsion force (i.e., a value of the propulsion force DF120 generated by the ship propulsion device 12 is zero) and the ship propulsion device 13 also does not generate a propulsion force (i.e., the value of the propulsion force DF130 generated by the ship propulsion device 13 is also zero). As a result, as shown in FIG. 8B and FIG. 10A, a value of the resultant force RL0 of the propulsion forces DF120 and DF130 generated by the ship propulsion devices 12 and 13 is also zero. Also, as shown in FIG. 8E, a value of a rotating moment generated by the ship propulsion devices 12 and 13 in the ship 1 are also zero.

Next, at time t3, as shown in FIG. 8D, FIG. 9A, and FIG. 10B, the ship propulsion device 12 generates a left-forward propulsion force DF123 of the ship 1. As shown in FIG. 8C, FIG. 9A, and FIG. 10B, the propulsion force DF123 generated by the ship propulsion device 12 forms an acute angle θ13 with respect to the front-to-rear direction (the vertical direction in FIGS. 9 and 10) of the ship 1.

Also, at time t3, as shown in FIG. 8D, FIG. 9A, and FIG. 10B, the ship propulsion device 13 generates a left-backward propulsion force DF133 of the ship 1. As shown in FIG. 8C, (A) FIG. 9A, and FIG. 10B, the propulsion force DF133 generated by the ship propulsion device 13 forms an acute angle θ13 with respect to the front-to-rear direction of the ship 1.

As a result, at time t3, as shown in FIG. 8B and FIG. 10B, the ship propulsion devices 12 and 13 generate a resultant force RL3 of the leftward propulsion forces DF123 and DF133 of the ship 1.

Also, at time t3, as shown in FIG. 8E and FIG. 9A, the ship propulsion devices 12 and 13 generate a counterclockwise rotating moment M2 (a rotating moment M2 in a direction in which the front portion 111 of the hull 11 relatively moves to the left with respect to the rear portion 112) in the ship 1.

Although an acute angle θ13 formed by the propulsion force DF123 generated by the ship propulsion device 12 with respect to the front-to-rear direction of the ship 1 and an acute angle θ13 formed by the propulsion force DF133 generated by the ship propulsion device 13 with respect to the front-to-rear direction of the ship 1 are equal in the examples shown in FIGS. 8 to 10, an acute angle formed by the propulsion force DF123 generated by the ship propulsion device 12 with respect to the front-to-rear direction of the ship 1 and an acute angle formed by the propulsion force DF133 generated by the ship propulsion device 13 with respect to the front-to-rear direction of the ship 1 may be different in another example.

During the period from time t3 to time t4, as shown in FIG. 8D, the ship propulsion device 12 continuously generates the left-forward propulsion force for the ship 1. Specifically, the magnitude of the left-forward propulsion force for the ship 1 generated by the ship propulsion device 12 decreases linearly. As shown in FIG. 8C, the value of the acute angle formed by the propulsion force generated by the ship propulsion device 12 and the front-to-rear direction (the vertical direction in FIGS. 9 and 10) of the ship 1 increases (for example, increases linearly) without decreasing on the way.

Also, during the period from time t3 to time t4, as shown in FIG. 8D, the ship propulsion device 13 continuously generates a left-backward propulsion force for the ship 1. Specifically, the magnitude of the left-backward propulsion force for the ship 1 generated by the ship propulsion device 13 decreases linearly. As shown in FIG. 8C, a value of an acute angle formed by the propulsion force generated by the ship propulsion device 13 and the front-to-rear direction of the ship 1 increases (for example, increases linearly) without decreasing on the way.

As a result, during the period from time t3 to time t4, as shown in FIG. 8B, a magnitude of a resultant force of the leftward propulsion forces for the ship 1 generated by the ship propulsion devices 12 and 13 is maintained at a value equal to a magnitude of the resultant force RL3.

Also, during the period from time t3 to time t4, as shown in FIG. 8E, a magnitude of a counterclockwise rotating moment generated by the ship propulsion devices 12 and 13 in the ship 1 (a rotating moment in a direction in which the front portion 111 of the hull 11 relatively moves to the left with respect to the rear portion 112) decreases linearly.

Although the magnitude of the resultant force of the leftward propulsion force for the ship 1 generated by the ship propulsion devices 12 and 13 is maintained at a constant value during the period from time t3 to time t4 in the example shown in FIGS. 8 to 10, the magnitude of the resultant force of the leftward propulsion forces for the ship 1 generated by the ship propulsion devices 12 and 13 may not be maintained at a constant value during the period from time t3 to time t4 in another example.

Subsequently, at time t4, as shown in FIG. 8C, FIG. 9B, and FIG. 10C, the left-forward propulsion force DF124 of the ship 1 generated by the ship propulsion device 12 forms an acute angle θ14 (>θ13) with respect to the front-to-rear direction of the ship 1 (the vertical direction in FIGS. 9 and 10).

Also, at time t4, as shown in FIG. 8C, FIG. 9B, and FIG. 10C, the left-backward propulsion force DF134 of the ship 1 generated by the ship propulsion device 13 forms an acute angle θ14 (>θ13) with respect to the front-to-rear direction of the ship 1.

As a result, at time t4, as shown in FIG. 8B and FIG. 10C, the ship propulsion devices 12 and 13 generate a resultant force RL4 of the leftward propulsion forces DF124 and DF134 of the ship 1. A magnitude of the resultant force RL4 is equal to the magnitude of the resultant force RL3.

Also, at time t4, as shown in FIG. 8E, the ship propulsion devices 12 and 13 do not generate a rotating moment in the ship 1. That is, the value of the rotating moment generated by the ship propulsion devices 12 and 13 in the ship 1 becomes zero.

Although an acute angle θ14 formed by the propulsion force DF124 of the ship 1 generated by the ship propulsion device 12 with respect to the front-to-rear direction of the ship 1 and an acute angle θ14 formed by the propulsion force DF134 of the ship 1 generated by the ship propulsion device 13 with respect to the front-to-rear direction of the ship 1 are equal in the examples shown in FIGS. 8 to 10, an acute angle formed by the propulsion force DF124 generated by the ship propulsion device 12 with respect to the front-to-rear direction of the ship 1 and an acute angle formed by the propulsion force DF134 generated by the ship propulsion device 13 with respect to the front-to-rear direction of the ship 1 may be different in another example.

During the period after time t4, as shown in FIG. 8D, the ship propulsion device 12 continuously generates the left-forward propulsion force for the ship 1. The magnitude of the left-forward propulsion force for the ship 1 continuously generated by the ship propulsion device 12 is equal to the magnitude of the propulsion force DF124.

Also, during the period after time t4, as shown in FIG. 8D, the ship propulsion device 13 continuously generates the left-backward propulsion force for the ship 1. The magnitude of the left-backward propulsion force for the ship 1 continuously generated by the ship propulsion device 13 is equal to the magnitude of the propulsion force DF134.

As a result, during the period after time t4, as shown in FIG. 8B and FIG. 10C, the ship propulsion devices 12 and 13 continuously generate the resultant force of the leftward propulsion forces for the ship 1. The magnitude of the resultant force of the leftward propulsion forces for the ship 1 continuously generated by the ship propulsion devices 12 and 13 is equal to the magnitude of the resultant force RL4.

Also, during the period after time t4, as shown in FIG. 8E, the ship propulsion devices 12 and 13 do not generate a rotating moment in the ship 1. That is, the value of the rotating moment generated by the ship propulsion devices 12 and 13 in the ship 1 is maintained at zero.

Although the magnitude of the resultant force of the leftward propulsion forces for the ship 1 generated by the ship propulsion devices 12 and 13 is maintained at a constant value during the period after time t4 in the examples shown in FIGS. 8 to 10, the magnitude of the resultant force of the leftward propulsion forces for the ship 1 generated by the ship propulsion devices 12 and 13 may not be maintained at a constant value during the period after time t4 in another example.

That is, in the example shown in FIGS. 8 to 10, during the period from time t3 to time t4 when the operation unit 11D is moved to the position P5, the ship propulsion device controller 14 causes the ship propulsion devices 12 and 13 to generate a rotating moment (a counterclockwise rotating moment) in a direction in which the front portion 111 of the hull 11 relatively moves to the left with respect to the rear portion 112 in the ship 1. Subsequently, during the period after time t4, the ship propulsion device controller 14 does not cause the ship propulsion devices 12 and 13 to generate a counterclockwise rotating moment in the ship 1.

Thus, in the examples shown in FIGS. 8 to 10, when the ship 1, which has been stopped, is moved to the left, it is possible to limit a possibility that the ship 1 will turn clockwise due to the start of a movement of the front portion 111 of the hull 11 being later than the start of a movement of the rear portion 112 of the hull 11 in the left direction.

Also, in the examples shown in FIGS. 8 to 10, during the period from time t3 to time t4, the ship propulsion device 12 generates a left-forward propulsion force forming an acute angle greater than or equal to the acute angle θ13 and less than the acute angle θ14 with respect to the front-to-rear direction of the ship 1 and the ship propulsion device 13 generates a left-backward propulsion force forming an acute angle greater than or equal to the acute angle θ13 and less than the acute angle θ14 with respect to the front-to-rear direction of the ship 1. Subsequently, during the period after time t4, the ship propulsion device 12 generates a left-forward propulsion force forming an acute angle θ14 (>θ13) with the front-to-rear direction of the ship 1 and the ship propulsion device 13 generates a left-backward propulsion force forming an acute angle θ14 (>θ13) with respect to the front-to-rear direction of the ship 1.

Specifically, in the examples shown in FIGS. 8 to 10, a value of the acute angle formed by the left-forward propulsion force generated by the ship propulsion device 12 with respect to the front-to-rear direction of the ship 1 during the period from time t3 to time t4 increases (for example, increases linearly) without decreasing on the way and a value of the acute angle formed by the left-backward propulsion force generated by the ship propulsion device 13 with respect to the front-to-rear direction of the ship 1 also increases (for example, increases linearly) without decreasing on the way.

Also, in the examples shown in FIGS. 8 to 10, a leftward resultant force of the left-forward propulsion force generated by the ship propulsion device 12 and the left-backward propulsion force generated by the ship propulsion device 13 during the period from time t3 to time t4 is equal to a leftward resultant force of the left-forward propulsion force generated by the ship propulsion device 12 and the left-backward propulsion force generated by the ship propulsion device 13 during the period after time t4 (i.e., magnitudes and directions of both propulsion forces are equal).

Thus, in the examples shown in FIGS. 8 to 10, the ship 1 can be quickly moved to the left during the period from time t3 to time t4, as in the period after time t4. That is, when the ship 1, which has been stopped, is moved to the left, it is possible to move the ship 1 quickly to the left while limiting a possibility that the start of a movement of the front portion 111 of the hull 11 will be later than the start of a movement of the rear portion 112 of the hull 11.

In the example in which the operation unit 11D (specifically, the tip of the lever of the joystick) is moved from the position P1 to the position P6 and maintained at the position P6, the movement path calculation unit 14A calculates a movement path P1→P6 of the tip of the lever of the joystick and the elapsed time calculation unit 14B calculates an elapsed time period from a timing when the tip of the lever of the joystick is moved from the position P1 to the position P6. The propulsion force calculation unit 14C calculates the magnitude of the propulsion force for moving the ship 1 in the left-forward direction. Also, the propulsion force calculation unit 14C calculates the counterclockwise rotating moment that is generated by the ship propulsion devices 12 and 13 in the ship 1.

In the example in which the operation unit 11D is moved from the position P1 to the position P6 and maintained at the position P6, the ship propulsion devices 12 and 13 generate a resultant force of the left-forward propulsion forces for the ship 1 during a period from a timing when the operation unit 11D is moved from the position P1 to the position P6 to a timing corresponding to time t4 in FIGS. 8A-FIG. 83. Also, during the above period, the ship propulsion devices 12 and 13 generate a counterclockwise rotating moment in the ship 1.

Also, in the example in which the operation unit 11D is moved from the position P1 to the position P6 and maintained at the position P6, the ship propulsion devices 12 and 13 subsequently generate the resultant force of the left-forward propulsion forces for the ship 1 during a period after the timing corresponding to time t4 in FIGS. 8A-FIG. 8E. On the other hand, during the above period, the ship propulsion devices 12 and 13 do not generate a counterclockwise rotating moment in the ship 1.

In the example in which the operation unit 11D (specifically, the tip of the lever of the joystick) is moved from the position P1 to the position P7 and maintained at the position P7, the movement path calculation unit 14A calculates a movement path P1→P7 of the tip of the lever of the joystick and the elapsed time calculation unit 14B calculates an elapsed time period from a timing when the tip of the lever of the joystick is moved from the position P1 to the position P7. The propulsion force calculation unit 14C calculates a magnitude of the propulsion force for moving the ship 1 in the left-backward direction. Also, the propulsion force calculation unit 14C calculates the counterclockwise rotating moment that is generated by the ship propulsion devices 12 and 13 in the ship 1.

In the example in which the operation unit 11D is moved from the position P1 to the position P7 and maintained at the position P7, the ship propulsion devices 12 and 13 generate a resultant force of the left-backward propulsion forces for the ship 1 during a period from a timing when the operation unit 11D is moved from the position P1 to the position P7 to a timing corresponding to time t4 in FIGS. 8A-FIG. 8E. Also, during the above period, the ship propulsion devices 12 and 13 generate a counterclockwise rotating moment in the ship 1.

Also, in the example in which the operation unit 11D is moved from the position P1 to the position P7 and maintained at the position P7, the ship propulsion devices 12 and 13 subsequently generate the resultant force of the left-backward propulsion forces for the ship 1 during a period after the timing corresponding to time t4 in FIGS. 8A-FIG. 8E. On the other hand, during the above period, the ship propulsion devices 12 and 13 do not generate a counterclockwise rotating moment in the ship 1.

Figure 11A:
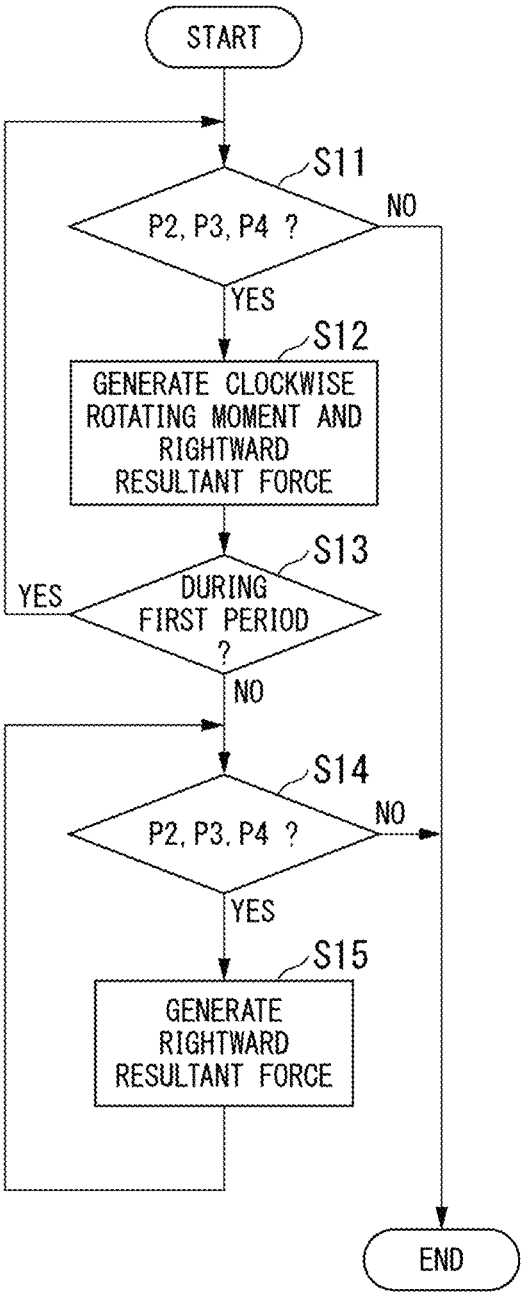
FIGS. 11A-FIG. 11B are a flowchart for describing an example of a process executed by a ship propulsion device controller of the first embodiment.
Figure 11B:
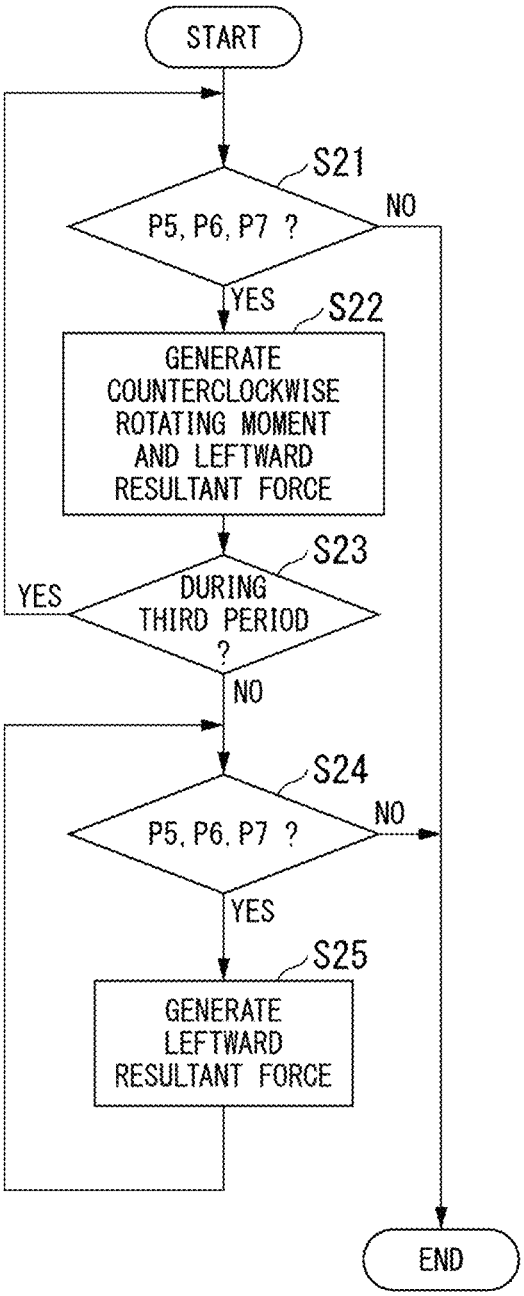

FIGS. 11A-FIG. 11B are a flowchart for describing an example of a process executed by the ship propulsion device controller 14 of the first embodiment.

The process shown in FIG. 11A and the process shown in FIG. 11B start when the position of the operation unit 11D (the joystick) has changed and are executed in parallel.

In the example shown in FIG. 11A, in step S11, the ship propulsion device controller 14 determines whether or not the operation unit 11D has been positioned at any one of the positions P2, P3, and P4. When the operation unit 11D has been positioned at any of the positions P2, P3, and P4, the process proceeds to step S12. On the other hand, when the operation unit 11D has not been positioned at any one of the positions P2, P3, and P4, the routine shown in FIG. 11A ends.

In step S12, the ship propulsion device controller 14 causes the ship propulsion devices 12 and 13 to generate a clockwise rotating moment M1 (a rotating moment M1 in a direction in which the front portion 111 of the hull 11 relatively moves to the right with respect to the rear portion 112) in the ship 1 and causes the ship propulsion devices 12 and 13 to generate a resultant force of the rightward, right-forward, or right-backward propulsion forces for the ship 1.

For example, in step S12, the magnitude of the right-backward propulsion force for the ship 1 generated by the ship propulsion device 12 decreases linearly and a value of an acute angle formed by the propulsion force generated by the ship propulsion device 12 with respect to the front-to-rear direction of the ship 1 increases linearly. Also, the magnitude of the right-forward propulsion force for the ship 1 generated by the ship propulsion device 13 decreases linearly and a value of an acute angle formed by the propulsion force generated by the ship propulsion device 13 with respect to the front-to-rear direction of the ship 1 increases linearly. As a result, the magnitude of the resultant force of the rightward, right-forward, or right-backward propulsion forces for the ship 1 generated by the ship propulsion devices 12 and 13 is maintained at a constant value.

In step S13, it is determined whether or not the ship propulsion device controller 14 is in a first period in which the ship propulsion devices 12 and 13 need to generate a clockwise rotating moment M1 in the ship 1. When the ship propulsion device controller 14 is in the first period in which the ship propulsion devices 12 and 13 need to generate the clockwise rotating moment M1 in the ship 1, the process returns to step S11. On the other hand, when the ship propulsion device controller 14 is in a second period in which the ship propulsion devices 12 and 13 do not need to generate the clockwise rotating moment M1 in the ship 1 (the second period after the elapse of the first period), the process proceeds to step S14.

In step S14, the ship propulsion device controller 14 determines whether or not the operation unit 11D has been maintained at any one of the positions P2, P3, and P4. When the operation unit 11D has been maintained at any one of the positions P2, P3, and P4, the process proceeds to step S15. On the other hand, when the operation unit 11D has not been maintained at any one of the positions P2, P3, and P4 (for example, when the operation unit 11D has automatically returned to the position P1), the routine shown in FIG. 11A ends.

In step S15, the ship propulsion device controller 14 does not cause the ship propulsion devices 12 and 13 to generate a clockwise rotating moment M1 (a rotating moment M1 in a direction in which the front portion 111 of the hull 11 relatively moves to the right with respect to the rear portion 112) in the ship 1 and causes the ship propulsion devices 12 and 13 to generate a resultant force of the rightward, right-forward, or right-backward propulsion forces for the ship 1.

For example, in step S15, a magnitude of the resultant force of the rightward, right-forward, or right-backward propulsion forces for the ship 1 generated by the ship propulsion devices 12 and 13 is maintained at the same value as during the first period.

In the example shown in FIG. 11B, in step S21, the ship propulsion device controller 14 determines whether or not the operation unit 11D has been positioned at any one of the positions P5, P6, and P7. When the operation unit 11D has been positioned at any one of the positions P5, P6, and P7, the process proceeds to step S22. On the other hand, when the operation unit 11D has not been positioned at any one of the positions P5, P6, and P7, the routine shown in FIG. 11B ends.

In step S22, the ship propulsion device controller 14 causes the ship propulsion devices 12 and 13 to generate a counterclockwise rotating moment M2 (a rotating moment M2 in a direction in which the front portion 111 of the hull 11 relatively moves to the left with respect to the rear portion 112) in the ship 1 and causes the ship propulsion devices 12 and 13 to generate a resultant force of the leftward, left-forward, or left-backward propulsion forces for the ship 1.

For example, in step S22, the magnitude of the left-forward propulsion force for the ship 1 generated by the ship propulsion device 12 decreases linearly and a value of an acute angle formed by the propulsion force generated by the ship propulsion device 12 with respect to the front-to-rear direction of the ship 1 increases linearly. Also, the magnitude of the left-backward propulsion force for the ship 1 generated by the ship propulsion device 13 decreases linearly and a value of an acute angle formed by the propulsion force generated by the ship propulsion device 13 with respect to the front-to-rear direction of the ship 1 increases linearly. As a result, the magnitude of the resultant force of the leftward, left-forward, or left-backward propulsion forces for the ship 1 generated by the ship propulsion devices 12 and 13 is maintained at a constant value.

In step S23, it is determined whether or not the ship propulsion device controller 14 is in a third period in which the ship propulsion devices 12 and 13 need to generate a counterclockwise rotating moment M2 in the ship 1. When the ship propulsion device controller 14 is in the third period in which the ship propulsion devices 12 and 13 need to generate the counterclockwise rotating moment M2 in the ship 1, the process returns to step S21. On the other hand, when the ship propulsion device controller 14 is in a fourth period in which the ship propulsion devices 12 and 13 do not need to generate the counterclockwise rotating moment M2 in the ship 1 (the fourth period after the elapse of the third period), the process proceeds to step S24.

In step S24, the ship propulsion device controller 14 determines whether or not the operation unit 11D has been maintained at any one of the positions P5, P6, and P7. When the operation unit 11D has been maintained at any one of the positions P5, P6, and P7, the process proceeds to step S25. On the other hand, when the operation unit 11D has not been maintained at any one of the positions P5, P6, and P7 (for example, when the operation unit 11D has automatically returned to the position P1), the routine shown in FIG. 11B ends.

In step S25, the ship propulsion device controller 14 does not cause the ship propulsion devices 12 and 13 to generate a counterclockwise rotating moment M2 (a rotating moment M2 in a direction in which the front portion 111 of the hull 11 relatively moves to the left with respect to the rear portion 112) in the ship 1 and causes the ship propulsion devices 12 and 13 to generate a resultant force of the leftward, left-forward, or left-backward propulsion forces for the ship 1.

For example, in step S25, a magnitude of the resultant force of the leftward, left-forward, or left-backward propulsion forces for the ship 1 generated by the ship propulsion devices 12 and 13 is maintained at the same value as during the third period.

Second Embodiment

Hereinafter, a second embodiment of a ship propulsion device controller, a ship propulsion device control method, and a program of the present invention will be described.

A ship propulsion device controller 14 of the second embodiment is configured similar to the ship propulsion device controller 14 of the first embodiment described above, except for differences described below. Therefore, according to the ship propulsion device controller 14 of the second embodiment, effects similar to those of the ship propulsion device controller 14 of the first embodiment described above can be obtained, except for the differences described below.

FIGS. 12A-FIG. 12E are diagrams for describing a resultant force of propulsion forces generated by ship propulsion devices 12 and 13 and the like when an operation unit 11D is moved from a position P1 to a position P2 and maintained at the position P2 in the second embodiment.

Figures 12A, 12B, 12C, 12D, 12E:
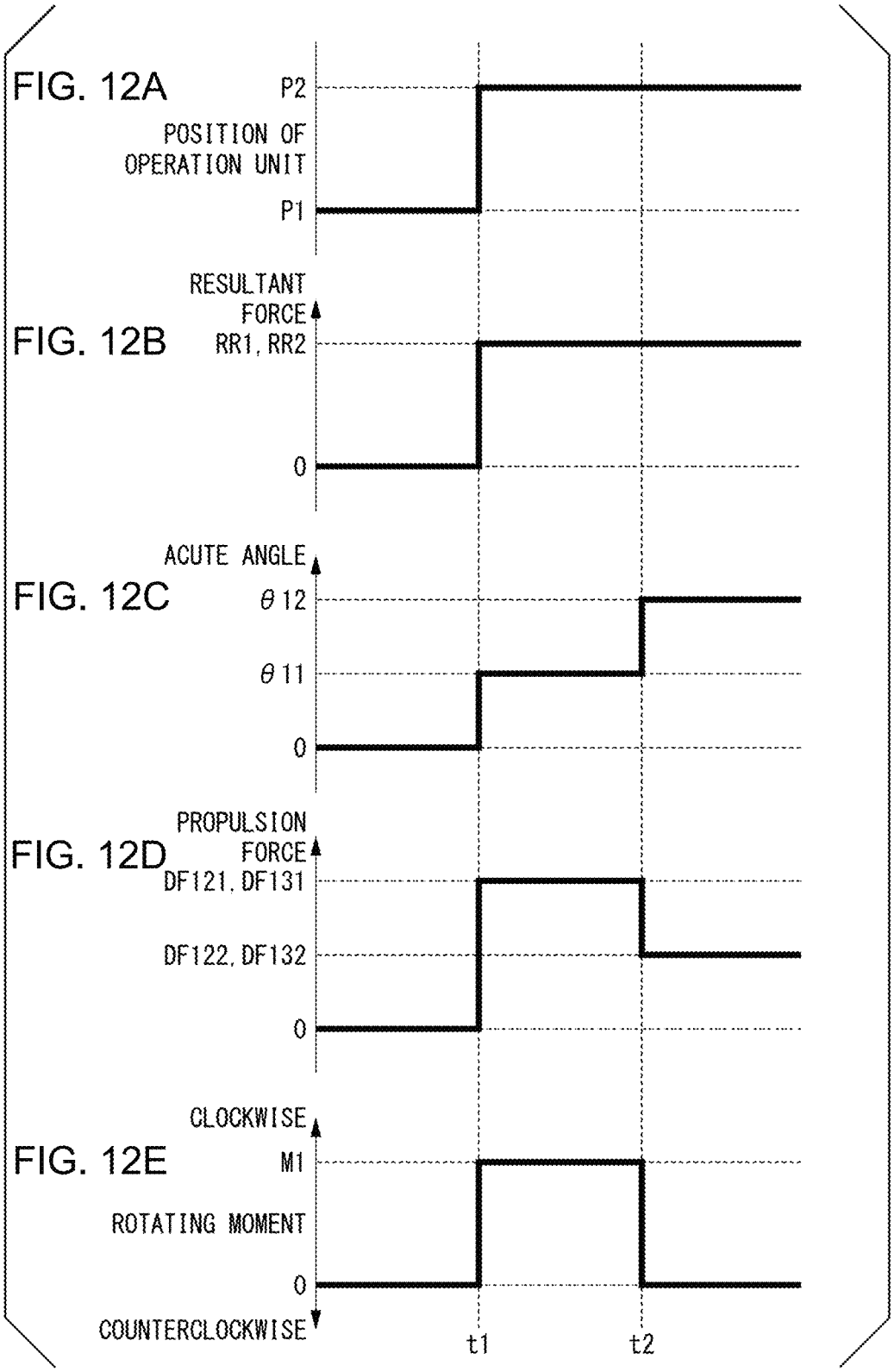
FIGS. 12A-FIG. 12E are diagrams for describing a resultant force of propulsion forces generated by ship propulsion devices and the like when an operation unit is moved from a position P1 to a position P2 and maintained at the position P2 in a second embodiment.

Specifically, FIG. 12A shows the positions P1 and P2 of the operation unit 11D during a period from a timing before time t1 to a timing after time t2, FIG. 12B shows a magnitude of a resultant force of propulsion forces generated by the ship propulsion devices 12 and 13 during the period from the timing before time t1 to the timing after time t2, FIG. 12C shows acute angles formed by the propulsion forces generated by the ship propulsion devices 12 and 13 with respect to the front-to-rear direction of the ship 1 during the period from the timing before time t1 to the timing after time t2, FIG. 12D shows magnitudes of the propulsion forces generated by the ship propulsion devices 12 and 13 during the period from the timing before time t1 to the timing after time t2, and FIG. 12E shows a magnitude and a direction of a rotating moment generated by the ship propulsion devices 12 and 13 in the ship 1 during the period from the timing before time t1 to the timing after time t2.

In the examples shown in FIGS. 12A-FIG. 12E, as shown in FIG. 12A, the operation unit 11D is positioned at the position P1 during the period before time t1, the operation unit 11D is moved from the position P1 to the position P2 at time t1, and the operation unit 11D is maintained at the position P2 during the period after time t1.

During the period before time t1, as shown in FIG. 12D, the ship propulsion device 12 does not generate a propulsion force (i.e., a value of the propulsion force generated by the ship propulsion device 12 is zero) and the ship propulsion device 13 also does not generate a propulsion force (i.e., the value of the propulsion force generated by the ship propulsion device 13 is also zero). As a result, as shown in FIG. 12B, a value of the resultant force of the propulsion forces generated by the ship propulsion devices 12 and 13 is also zero. Also, as shown in FIG. 12E, a value of a rotating moment generated by the ship propulsion devices 12 and 13 in the ship 1 are also zero.

Next, at time t1, as shown in FIG. 12D, the ship propulsion device 12 generates a right-backward propulsion force DF121 (see FIG. 6A) of the ship 1. The propulsion force DF121 generated by the ship propulsion device 12 forms an acute angle θ11 (see FIG. 6A) with respect to the front-to-rear direction (the vertical direction in FIGS. 6A-FIG. 6B) of the ship 1.

Also, at time t1, as shown in FIG. 12D, the ship propulsion device 13 generates a right-forward propulsion force DF131 (see FIG. 6A) of the ship 1. The propulsion force DF131 generated by the ship propulsion device 13 forms an acute angle θ11 (see FIG. 6A) with respect to the front-to-rear direction of the ship 1.

As a result, at time t1, as shown in FIG. 12B, the ship propulsion devices 12 and 13 generate a resultant force RR1 (see FIG. 7B) of the rightward propulsion forces DF121 and DF131 of the ship 1.

Also, at time t1, as shown in FIG. 12E, the ship propulsion devices 12 and 13 generate a clockwise rotating moment M1 (a rotating moment M1 in a direction in which the front portion 111 of the hull 11 relatively moves to the right with respect to the rear portion 112) (see FIG. 6A) in the ship 1.

Although an acute angle θ11 formed by the propulsion force DF121 generated by the ship propulsion device 12 with respect to the front-to-rear direction of the ship 1 and an acute angle θ11 formed by the propulsion force DF131 generated by the ship propulsion device 13 with respect to the front-to-rear direction of the ship 1 are equal in the examples shown in FIGS. 12A-FIG. 12E, an acute angle formed by the propulsion force DF121 generated by the ship propulsion device 12 with respect to the front-to-rear direction of the ship 1 and an acute angle formed by the propulsion force DF131 generated by the ship propulsion device 13 with respect to the front-to-rear direction of the ship 1 may be different in another example.

During the period from time t1 to time t2, as shown in FIG. 12D, the ship propulsion device 12 continuously generates the right-backward propulsion force for the ship 1. Specifically, the magnitude of the right-backward propulsion force for the ship 1 generated by the ship propulsion device 12 is maintained at a value equal to the magnitude of the propulsion force DF121. As shown in FIG. 12C, a value of the acute angle formed by the propulsion force generated by the ship propulsion device 12 and the front-to-rear direction (the vertical direction in FIGS. 6A-FIG. 6B) of the ship 1 is also maintained at an acute angle equal to the acute angle θ11.

Also, during the period from time t1 to time t2, as shown in FIG. 12D, the ship propulsion device 13 continuously generates a right-forward propulsion force for the ship 1. Specifically, the magnitude of the right-forward propulsion force for the ship 1 generated by the ship propulsion device 13 is maintained at a value equal to the magnitude of the propulsion force DF131. As shown in FIG. 12C, a value of the acute angle formed by the propulsion force generated by the ship propulsion device 13 and the front-to-rear direction of the ship 1 is also maintained at an acute angle equal to the acute angle θ11.

As a result, during the period from time t1 to time t2, as shown in FIG. 12B, a magnitude of a resultant force of the rightward propulsion forces for the ship 1 generated by the ship propulsion devices 12 and 13 is maintained at a value equal to a magnitude of the resultant force RR1.

Also, during the period from time t1 to time t2, as shown in FIG. 12E, the magnitude of the clockwise rotating moment generated by the ship propulsion devices 12 and 13 (a rotating moment in a direction in which the front portion 111 of the hull 11 relatively moves to the right with respect to the rear portion 112) in the ship 1 is maintained at a value equal to the magnitude of the rotating moment M1.

Although the magnitude of the resultant force of the rightward propulsion forces for the ship 1 generated by the ship propulsion devices 12 and 13 is maintained at a constant value during the period from time t1 to time t2 in the example shown in FIGS. 12A-FIG. 12E, the magnitude of the resultant force of the rightward propulsion forces for the ship 1 generated by the ship propulsion devices 12 and 13 may not be maintained at a constant value during the period from time t1 to time t2 in another example.

Subsequently, at time t2, as shown in FIG. 12D, the value of the right-backward propulsion force DF122 (see FIG. 6B) of the ship 1 generated by the ship propulsion device 12 decreases step by step from the value of the propulsion force DF121 (see FIG. 6A). Further, as shown in FIG. 12C, an acute angle θ12 formed by the right-backward propulsion force DF122 of the ship 1 generated by the ship propulsion device 12 with respect to the front-to-rear direction (the vertical direction in FIGS. 6A-FIG. 6B) of the ship 1 (FIG. 6B) increases step by step from the value of the acute angle θ11 (see FIG. 6A). That is, in the example shown in FIGS. 12A-FIG. 12E, the value of the acute angle formed by the propulsion force generated by the ship propulsion device 12 and the front-to-rear direction of the ship 1 increases during the period from time t1 to time t2 without decreasing on the way.

Also, at time t2, as shown in FIG. 12D, the value of the right-forward propulsion force DF132 (see FIG. 6B) of the ship 1 generated by the ship propulsion device 13 decreases step by step from a value of the propulsion force DF131 (see FIG. 6A). Further, as shown in FIG. 12C, the value of the acute angle 612 (see FIG. 6B) formed by the right-forward propulsion force DF132 of the ship 1 generated by the ship propulsion device 13 with respect to the front-to-rear direction of the ship 1 increases step by step from the value of the acute angle 611 (see FIG. 6A). That is, in the example shown in FIGS. 12A-FIG. 12E, the value of the acute angle formed by the propulsion force generated by the ship propulsion device 13 and the front-to-rear direction of the ship 1 increases during the period from time t1 to time t2 without decreasing on the way.

As a result, at time t2, as shown in FIG. 12B, the ship propulsion devices 12 and 13 generate the resultant force RR2 (see FIG. 7C) of the rightward propulsion forces DF122 and DF132 of the ship 1. The magnitude of the resultant force RR2 is equal to the magnitude of the resultant force RR1 (see FIG. 7B).

Also, at time t2, as shown in FIG. 12E, the ship propulsion devices 12 and 13 do not generate a rotating moment in the ship 1. That is, the value of the rotating moment generated by the ship propulsion devices 12 and 13 in the ship 1 becomes zero.

Although an acute angle 612 formed by the propulsion force DF122 of the ship 1 generated by the ship propulsion device 12 with respect to the front-to-rear direction of the ship 1 and an acute angle θ12 formed by the propulsion force DF132 of the ship 1 generated by the ship propulsion device 13 with respect to the front-to-rear direction of the ship 1 are equal in the examples shown in FIGS. 12A-FIG. 12E, an acute angle formed by the propulsion force DF122 generated by the ship propulsion device 12 with respect to the front-to-rear direction of the ship 1 and an acute angle formed by the propulsion force DF132 generated by the ship propulsion device 13 with respect to the front-to-rear direction of the ship 1 may be different in another example.

During the period after time t2, as shown in FIG. 12D, the ship propulsion device 12 continuously generates the right-backward propulsion force for the ship 1. The magnitude of the right-backward propulsion force for the ship 1 continuously generated by the ship propulsion device 12 is equal to the magnitude of the propulsion force DF122 (see FIG. 6B).

Also, during the period after time t2, as shown in FIG. 12D, the ship propulsion device 13 continuously generates the right-forward propulsion force for the ship 1. The magnitude of the right-forward propulsion force for the ship 1 continuously generated by the ship propulsion device 13 is equal to the magnitude of the propulsion force DF132 (see FIG. 6B).

As a result, during the period after time t2, as shown in FIG. 12B, the ship propulsion devices 12 and 13 continuously generate the resultant force of the rightward propulsion forces for the ship 1. The magnitude of the resultant force of the rightward propulsion forces for the ship 1 continuously generated by the ship propulsion devices 12 and 13 is equal to the magnitude of the resultant force RR2 (see FIG. 7C).

Also, during the period after time t2, as shown in FIG. 12E, the ship propulsion devices 12 and 13 do not generate a rotating moment in the ship 1. That is, the value of the rotating moment generated by the ship propulsion devices 12 and 13 in the ship 1 is maintained at zero.

Although the magnitude of the resultant force of the rightward propulsion forces for the ship 1 generated by the ship propulsion devices 12 and 13 is maintained at a constant value during the period after time t2 in the examples shown in FIGS. 12A-FIG. 12E, the magnitude of the resultant force of the rightward propulsion forces for the ship 1 generated by the ship propulsion devices 12 and 13 may not be maintained at a constant value during the period after time t2 in another example.

FIGS. 13A-FIG. 13E are diagrams for describing a resultant force of propulsion forces generated by the ship propulsion devices 12 and 13 and the like when an operation unit 11D is moved from the position P1 to a position P5 and maintained at the position P5 in the second embodiment.

Figures 13A, 13B, 13C, 13D, 13E:
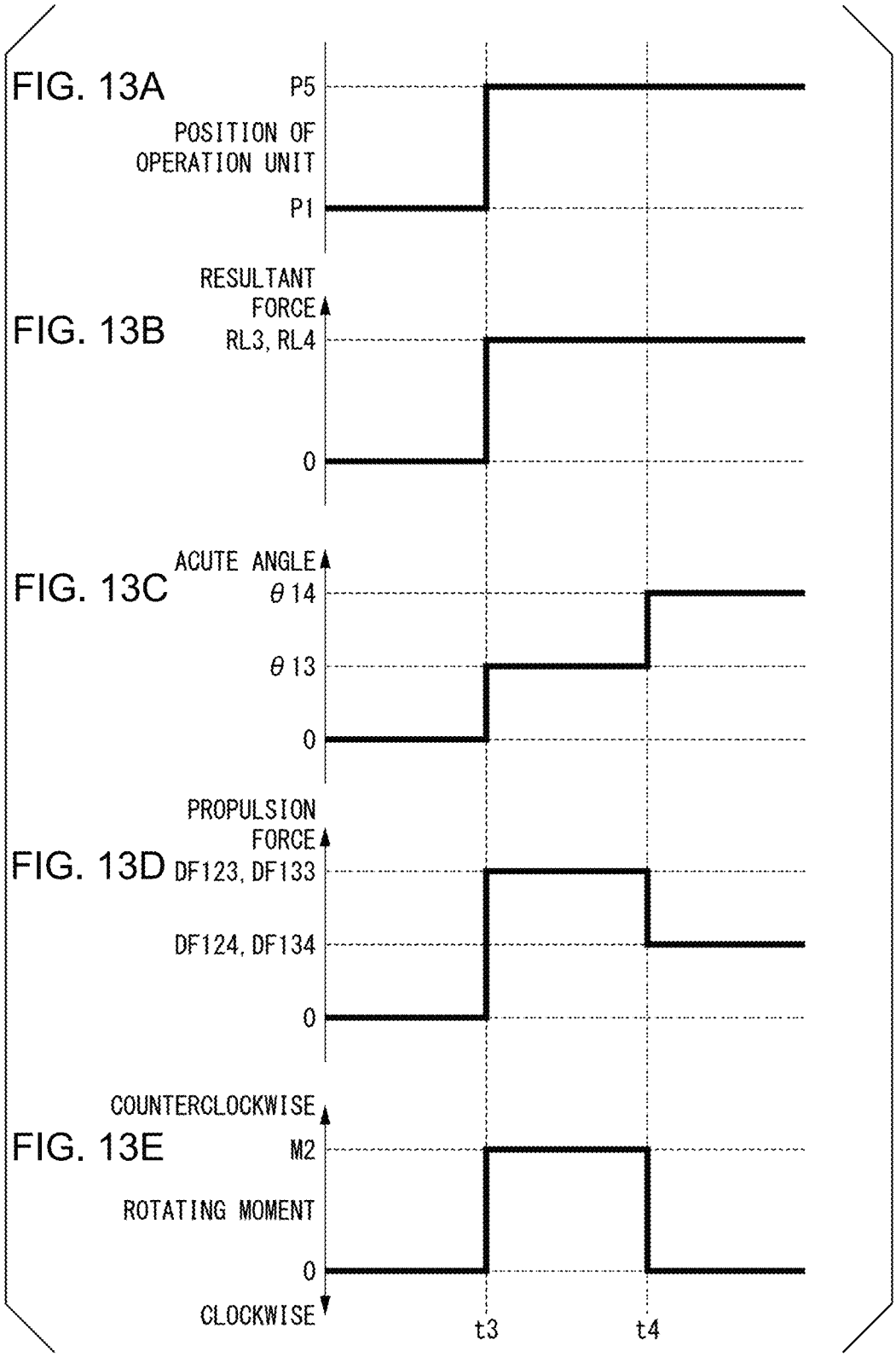
FIGS. 13A-FIG. 13E are diagrams for describing a resultant force of propulsion forces generated by ship propulsion devices and the like when the operation unit is moved from the position P1 to a position P5 and maintained at the position P5 in the second embodiment.

Specifically, FIG. 13A shows the positions P1 and P5 of the operation unit 11D during a period from a timing before time t3 to a timing after time t4, FIG. 13B shows a magnitude of a resultant force of propulsion forces generated by the ship propulsion devices 12 and 13 during the period from the timing before time t3 to the timing after time t4, FIG. 13C shows acute angles formed by the propulsion forces generated by the ship propulsion devices 12 and 13 with respect to the front-to-rear direction of the ship 1 during the period from the timing before time t3 to the timing after time t4, FIG. 13D shows magnitudes of the propulsion forces generated by the ship propulsion devices 12 and 13 during the period from the timing before time t3 to the timing after time t4, and FIG. 13E shows a magnitude and a direction of a rotating moment generated by the ship propulsion devices 12 and 13 in the ship 1 during the period from the timing before time t3 to the timing after time t4.

In the examples shown in FIGS. 13A-FIG. 13E, as shown in FIG. 13A, the operation unit 11D is positioned at the position P1 during the period before time t3, the operation unit 11D is moved from the position P1 to the position P5 at time t3, and the operation unit 11D is maintained at the position P5 during the period after time t3.

During the period before time t3, as shown in FIG. 13D, the ship propulsion device 12 does not generate a propulsion force (i.e., a value of the propulsion force generated by the ship propulsion device 12 is zero) and the ship propulsion device 13 also does not generate a propulsion force (i.e., the value of the propulsion force generated by the ship propulsion device 13 is also zero). As a result, as shown in FIG. 13B, a value of the resultant force of the propulsion forces generated by the ship propulsion devices 12 and 13 is also zero. Also, as shown in FIG. 13E, a value of a rotating moment generated by the ship propulsion devices 12 and 13 in the ship 1 are also zero.

Next, at time t3, as shown in FIG. 13D, the ship propulsion device 12 generates a left-forward propulsion force DF123 (see FIG. 9A) of the ship 1. The propulsion force DF123 generated by the ship propulsion device 12 forms an acute angle θ13 (see FIG. 9A) with respect to the front-to-rear direction (the vertical direction in FIGS. 9A-FIG. 9B) of the ship 1.

Also, at time t3, as shown in FIG. 13D, the ship propulsion device 13 generates a left-backward propulsion force DF133 (see FIG. 9A) of the ship 1. The propulsion force DF133 generated by the ship propulsion device 13 forms an acute angle θ13 (see FIG. 9A) with respect to the front-to-rear direction of the ship 1.

As a result, at time t3, as shown in FIG. 13B, the ship propulsion devices 12 and 13 generate a resultant force RL3 (see FIG. 10B) of the leftward propulsion forces DF123 and DF133 of the ship 1.

Also, at time t3, as shown in FIG. 13E, the ship propulsion devices 12 and 13 generate a counterclockwise rotating moment M2 (a rotating moment M2 in a direction in which the front portion 111 of the hull 11 relatively moves to the left with respect to the rear portion 112) (see FIG. 9A) in the ship 1.

Although an acute angle θ13 formed by the propulsion force DF123 generated by the ship propulsion device 12 with respect to the front-to-rear direction of the ship 1 and an acute angle θ13 formed by the propulsion force DF133 generated by the ship propulsion device 13 with respect to the front-to-rear direction of the ship 1 are equal in the examples shown in FIGS. 13A-FIG. 13E, an acute angle formed by the propulsion force DF123 generated by the ship propulsion device 12 with respect to the front-to-rear direction of the ship 1 and an acute angle formed by the propulsion force DF133 generated by the ship propulsion device 13 with respect to the front-to-rear direction of the ship 1 may be different in another example.

During the period from time t3 to time t4, as shown in FIG. 13D, the ship propulsion device 12 continuously generates the left-forward propulsion force for the ship 1. Specifically, the magnitude of the left-forward propulsion force for the ship 1 generated by the ship propulsion device 12 is maintained at a value equal to the magnitude of the propulsion force DF123. As shown in FIG. 13C, a value of the acute angle formed by the propulsion force generated by the ship propulsion device 12 and the front-to-rear direction (the vertical direction in FIGS. 9A-FIG. 9B) of the ship 1 is also maintained at an acute angle equal to the acute angle θ13.

Also, during the period from time t3 to time t4, as shown in FIG. 13D, the ship propulsion device 13 continuously generates a left-backward propulsion force for the ship 1. Specifically, the magnitude of the left-backward propulsion force for the ship 1 generated by the ship propulsion device 13 is maintained at a value equal to the magnitude of the propulsion force DF133. As shown in FIG. 12C, a value of the acute angle formed by the propulsion force generated by the ship propulsion device 13 and the front-to-rear direction of the ship 1 is also maintained at an acute angle equal to the acute angle θ13.

As a result, during the period from time t3 to time t4, as shown in FIG. 13B, a magnitude of a resultant force of the rightward propulsion forces for the ship 1 generated by the ship propulsion devices 12 and 13 is maintained at a value equal to a magnitude of the resultant force RL3.

Also, during the period from time t3 to time t4, as shown in FIG. 13E, the magnitude of the counterclockwise rotating moment generated by the ship propulsion devices 12 and 13 (a rotating moment in a direction in which the front portion 111 of the hull 11 relatively moves to the left with respect to the rear portion 112) in the ship 1 is maintained at a value equal to the magnitude of the rotating moment M2.

Although the magnitude of the resultant force of the leftward propulsion forces for the ship 1 generated by the ship propulsion devices 12 and 13 is maintained at a constant value during the period from time t3 to time t4 in the example shown in FIGS. 13A-FIG. 13E, the magnitude of the resultant force of the leftward propulsion forces for the ship 1 generated by the ship propulsion devices 12 and 13 may not be maintained at a constant value during the period from time 13 to time t4 in another example.

Subsequently, at time t4, as shown in FIG. 13D, the value of the left-forward propulsion force DF124 (see FIG. 9B) of the ship 1 generated by the ship propulsion device 12 decreases step by step from the value of the propulsion force DF123 (see FIG. 9A). Further, as shown in FIG. 13C, the acute angle θ14 formed by the left-forward propulsion force DF124 of the ship 1 generated by the ship propulsion device 12 with respect to the front-to-rear direction (the vertical direction in FIGS. 9A-FIG. 9B) of the ship 1 (FIG. 9B) increases step by step from the value of the acute angle θ13 (see FIG. 9A). That is, in the example shown in FIGS. 13A-FIG. 13E, the value of the acute angle formed by the propulsion force generated by the ship propulsion device 12 and the front-to-rear direction of the ship 1 increases during the period from time t3 to time t4 without decreasing on the way.

Also, at time t4, as shown in FIG. 13D, the value of the left-backward propulsion force DF134 (see FIG. 9B) of the ship 1 generated by the ship propulsion device 13 decreases step by step from a value of the propulsion force DF133 (see FIG. 9A). Further, as shown in FIG. 13C, the value of the acute angle θ14 (see FIG. 9B) formed by the left-backward propulsion force DF134 of the ship 1 generated by the ship propulsion device 13 with respect to the front-to-rear direction of the ship 1 increases step by step from the value of the acute angle θ13 (see FIG. 9A). That is, in the example shown in FIGS. 13A-FIG. 13E, the value of the acute angle formed by the propulsion force generated by the ship propulsion device 13 and the front-to-rear direction of the ship 1 increases during the period from time t3 to time t4 without decreasing on the way.

As a result, at time t4, as shown in FIG. 13B, the ship propulsion devices 12 and 13 generate a resultant force RL4 (see FIG. 10C) of the leftward propulsion forces DF124 and DF134 of the ship 1. A magnitude of the resultant force RL4 is equal to the magnitude of the resultant force RL3 (see FIG. 10B).

Also, at time t4, as shown in FIG. 13E, the ship propulsion devices 12 and 13 do not generate a rotating moment in the ship 1. That is, the value of the rotating moment generated by the ship propulsion devices 12 and 13 in the ship 1 becomes zero.

Although an acute angle θ14 formed by the propulsion force DF124 of the ship 1 generated by the ship propulsion device 12 with respect to the front-to-rear direction of the ship 1 and an acute angle θ14 formed by the propulsion force DF134 of the ship 1 generated by the ship propulsion device 13 with respect to the front-to-rear direction of the ship 1 are equal in the examples shown in FIGS. 13A-FIG. 13E, an acute angle formed by the propulsion force DF124 generated by the ship propulsion device 12 with respect to the front-to-rear direction of the ship 1 and an acute angle formed by the propulsion force DF134 generated by the ship propulsion device 13 with respect to the front-to-rear direction of the ship 1 may be different in another example.

During the period after time t4, as shown in FIG. 13D, the ship propulsion device 12 continuously generates the left-forward propulsion force for the ship 1. The magnitude of the left-forward propulsion force for the ship 1 continuously generated by the ship propulsion device 12 is equal to the magnitude of the propulsion force DF124 (see FIG. 9B).

Also, during the period after time t4, as shown in FIG. 13D, the ship propulsion device 13 continuously generates the left-backward propulsion force for the ship 1. The magnitude of the left-backward propulsion force for the ship 1 continuously generated by the ship propulsion device 13 is equal to the magnitude of the propulsion force DF134 (see FIG. 9B).

As a result, during the period after time t4, as shown in FIG. 13B, the ship propulsion devices 12 and 13 continuously generate the resultant force of the leftward propulsion forces for the ship 1. The magnitude of the resultant force of the leftward propulsion forces for the ship 1 continuously generated by the ship propulsion devices 12 and 13 is equal to the magnitude of the resultant force RL4 (see FIG. 10C).

Also, during the period after time t4, as shown in FIG. 13E, the ship propulsion devices 12 and 13 do not generate a rotating moment in the ship 1. That is, the value of the rotating moment generated by the ship propulsion devices 12 and 13 in the ship 1 is maintained at zero.

Although the magnitude of the resultant force of the leftward propulsion forces for the ship 1 generated by the ship propulsion devices 12 and 13 is maintained at a constant value during the period after time t4 in the examples shown in FIGS. 13A-FIG. 13E, the magnitude of the resultant force of the leftward propulsion forces for the ship 1 generated by the ship propulsion devices 12 and 13 may not be maintained at a constant value during the period after time t4 in another example.

Third Embodiment

Hereinafter, a third embodiment of a ship propulsion device controller, a ship propulsion device control method, and a program of the present invention will be described.

A ship propulsion device controller 14 of the third embodiment is configured similar to the ship propulsion device controller 14 of the first or second embodiment described above, except for differences described below. Therefore, according to the ship propulsion device controller 14 of the third embodiment, effects similar to those of the ship propulsion device controller 14 of the first or second embodiment described above can be obtained, except for the differences described below.

The ship 1 (see FIG. 1) to which the ship propulsion device controller 14 of the first or second embodiment is applied includes the two ship propulsion devices 12 and 13.

On the other hand, a ship 1 to which the ship propulsion device controller 14 of the third embodiment is applied includes three or more ship propulsion devices (not shown).

When the operation unit 11D is moved from a position P1 to a position P2 and maintained at the position P2, the ship propulsion device controller 14 of the third embodiment causes the three or more ship propulsion devices to generate a clockwise rotating moment, which is a rotating moment in a direction in which a front portion 111 of a hull 11 relatively moves to the right with respect to the rear portion 112, in the ship 1 during a first period from time t1 when the operation unit 11D has been moved to the position P2 to time t2 and subsequently does not cause the three or more ship propulsion devices to generate the clockwise rotating moment in the ship 1 during a second period after time t2.

Also, when the operation unit 11D is moved from the position P1 to a position P5 and maintained at the position P5, the ship propulsion device controller 14 of the third embodiment causes the three or more ship propulsion devices to generate a counterclockwise rotating moment, which is a rotating moment in a direction in which a front portion 111 of a hull 11 relatively moves to the left with respect to the rear portion 112, in the ship 1 during a third period from time t3 when the operation unit 11D has been moved to the position P5 to time t4 and subsequently does not cause the three or more ship propulsion devices to generate the counterclockwise rotating moment in the ship 1 during a fourth period after time t4.

Fourth Embodiment

Hereinafter, a fourth embodiment of a ship propulsion device controller, a ship propulsion device control method, and a program of the present invention will be described.

A ship 1 to which the ship propulsion device controller 14 of the fourth embodiment is applied is configured similar to the ship 1 to which the ship propulsion device controller 14 of the first to third embodiments described above is applied, except for differences described below. Therefore, according to the ship 1 of the fourth embodiment, effects similar to those of the ship 1 of the first to third embodiments described above can be obtained, except for the differences described below.

Figure 14:
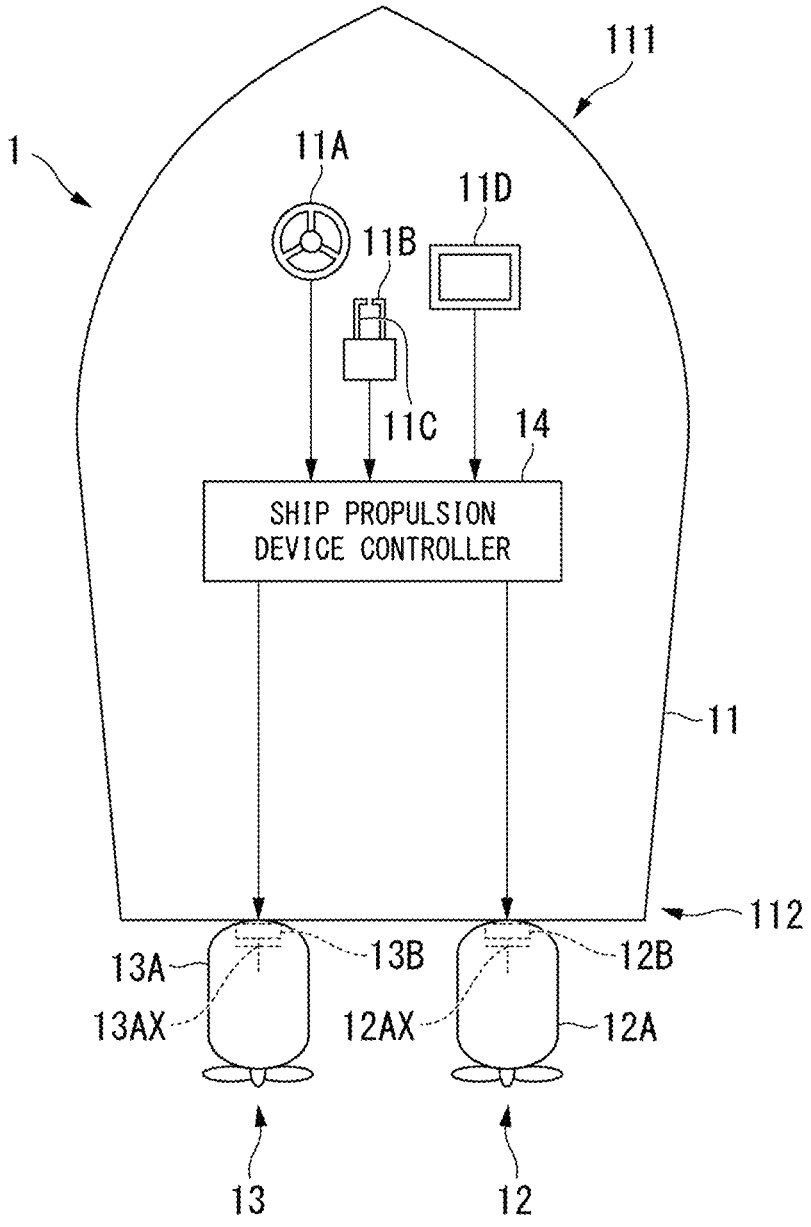
FIG. 14 is a diagram showing an example of a ship to which a ship propulsion device controller of a fourth embodiment is applied.

FIG. 14 is a diagram showing an example of a ship 1 to which the ship propulsion device controller 14 of the fourth embodiment is applied.

As described above, in the ship 1 of the first embodiment (the examples shown in FIG. 1 and FIG. 2), the operation unit 11D includes the joystick having the lever.

On the other hand, in the ship 1 of the fourth embodiment (example shown in FIG. 14), an operation unit 11D includes a touch panel. A ship operator can not only operate propulsion units 12A1 and 13A1 and steering actuators 12A2 and 13A2 by operating a steering device 11A (a steering wheel) and remote control devices 11B and 11C (remote control levers), but also operate the propulsion units 12A1 and 13A1 and the steering actuators 12A2 and 13A2 by operating the operation unit 11D (a touch panel).

In another example, the hull 11 may not include the steering device 11A, the remote control device 11B, and the remote control device 11C.

In the example shown in FIG. 14, the ship propulsion device controller 14 controls the steering actuator 12A2 and the propulsion unit 12A1 of the ship propulsion device 12 and the steering actuator 13A2 and the propulsion unit 13A1 of the ship propulsion device 13 on the basis of an input operation on the operation unit 11D.

Specifically, the ship propulsion device controller 14 controls magnitudes and directions of the propulsion forces for the ship 1 that are generated by the propulsion units 12A1 and 13A1 and the steering actuators 12A2 and 13A2 and a magnitude and a direction of a rotating moment thereof on the basis of, for example, a flick input operation on the operation unit 11D (the touch panel).

In the flick input operation, for example, the ship operator allows his/her finger pressing the touch panel to slide in a desired direction while pressing the touch panel.

A movement path calculation unit 14A calculates a movement path of the operation unit 11D. Specifically, the movement path calculation unit 14A calculates a movement path of the finger of the ship operator which slides while pressing the touch panel.

An elapsed time calculation unit 14B calculates an elapsed time period from a timing when the operation unit 11D (the finger of the ship operator pressing the touch panel) is moved to a certain position.

A propulsion force calculation unit 14C calculates propulsion forces that are generated by the ship propulsion devices 12 and 13 on the basis of the movement path of the operation unit 11D calculated by the movement path calculation unit 14A (the movement path of the finger which slides while pressing the touch panel) and the elapsed time period calculated by the elapsed time calculation unit 14B.

Also, the propulsion force calculation unit 14C calculates a rotating moment generated by the ship propulsion devices 12 and 13 in the ship 1 on the basis of the movement path of the operation unit 11D calculated by the movement path calculation unit 14A and the elapsed time period calculated by the elapsed time calculation unit 14B.

In the example shown in FIG. 14, the operation unit 11D is configured so that the flick input operation can be performed on the operation unit 11D (the touch panel) and a rotation input operation can be performed thereon.

For example, the ship operator performs the rotation input operation by allowing another finger of the ship operator to slide in a circumferential direction while pressing the touch panel in a state in which one finger of the ship operator comes into contact with the touch panel and fixed as a center point.

When the ship operator performs a clockwise rotation input operation on the operation unit 11D (the touch panel), the ship propulsion device controller 14 controls the propulsion units 12A1 and 13A1 and the steering actuators 12A2 and 13A2 so that the hull 11 turns to the right. On the other hand, when the ship operator performs a counterclockwise rotation input operation on the operation unit 11D (the touch panel), the ship propulsion device controller 14 controls the propulsion units 12A1 and 13A1 and the steering actuators 12A2 and 13A2 so that the hull 11 turns to the left.

Also, when the ship operator performs a flick input operation on the operation unit 11D (the touch panel), the ship propulsion device controller 14 controls the propulsion units 12A1 and 13A1 and the steering actuators 12A2 and 13A2 so that the hull 11 moves in a direction in which the ship operator's finger is allowed to slide while the attitude is maintained. That is, when the ship operator performs a flick input operation on the operation unit 11D (the touch panel), the front portion 11I of the hull 11 and the rear portion 112 of the hull 11 performs a translational movement.

When the ship operator does not perform a flick input operation on the operation unit 11D (the touch panel) (i.e., when the ship operator's finger does not come into contact with the touch panel), the operation unit 11D is in a state similar to the state shown in FIG. 3A. As a result, the ship propulsion device controller 14 does not cause the propulsion units 12A1 and 13A1 and the steering actuators 12A2 and 13A2 to generate the propulsion forces for the ship 1.

Although modes for carrying out the present invention have been described above using the embodiments, the present invention is not limited to the embodiments and various modifications and replacements can be applied without departing from the spirit and scope of the present invention. The configurations described in the above-described embodiments and the above-described examples may be combined.

Also, all or some of the functions of the parts provided in the ship propulsion device controller 14 according to the above-described embodiment may be implemented by recording a program for implementing the functions on a computer-readable recording medium and causing a computer system to read and execute the program recorded on the recording medium. Also, the "computer system" described here is assumed to include an operating system (OS) and hardware such as peripheral devices.

Also, the "computer-readable recording medium" refers to a flexible disk, a magneto-optical disc, a ROM, a portable medium such as a CD-ROM, or a storage unit such as a hard disk embedded in the computer system. Further, the "computer-readable recording medium" may include a computer-readable recording medium for dynamically retaining the program for a short time period as in a communication line when the program is transmitted via a network such as the Internet or a communication circuit such as a telephone circuit and a computer-readable recording medium for retaining the program for a given time period as in a volatile memory inside the computer system including a server and a client when the program is transmitted. Also, the above-described program may be a program for implementing some of the above-described functions. Further, the above-described program may be a program capable of implementing the above-described function in combination with a program already recorded on the computer system.

REFERENCE SIGNS LIST

1 Ship
11 Hull
111 Front portion
112 Rear portion
11A Steering device
11B Remote control device
11C Remote control device
11D Operation unit
P1 Position
P2 Position
P3 Position
P4 Position
P5 Position
P6 Position
P7 Position
P8 Position
P9 Position
12 Ship propulsion device
12A Ship propulsion device main body
12A1 Propulsion unit
12A2 Steering actuator
12AX Steering shaft
12B Bracket
13 Ship propulsion device
13A Ship propulsion device main body
13A1 Propulsion unit
13A2 Steering actuator
13AX Steering shaft
13B Bracket
14 Ship propulsion device controller
14A Movement path calculation unit
14B Elapsed time calculation unit
14C Propulsion force calculation unit

What is claimed is:

1. A ship propulsion device controller for controlling a plurality of ship propulsion devices disposed on a rear portion of a hull of a ship, wherein each of the plurality of ship propulsion devices comprises a propulsion unit configured to generate a propulsion force of the ship; and a steering actuator, wherein the ship comprises an operation unit configured to operate the propulsion unit and the steering actuator, wherein the operation unit is able to be positioned at least at a neutral region where the plurality of ship propulsion devices do not generate propulsion forces for the ship and a right-side propulsion force generating region where the plurality of ship propulsion devices generate propulsion forces for moving the ship in a right direction, a right-forward direction, or a right-backward direction or a left-side propulsion force generating region where the plurality of ship propulsion devices generate propulsion forces for moving the ship in a left direction, a left-forward direction, or a left-backward direction, wherein, in a state in which the operation unit is moved from the neutral region to right-side propulsion force generating region and maintained therein, the ship propulsion device controller causes the plurality of ship propulsion devices to generate a first rotating moment that is a rotating moment in a direction in which a front portion of the hull relatively moves to the right with respect to the rear portion in the ship during only a first predetermined period immediately after the operation unit is moved to right-side propulsion force generating region, without the operation unit being instructed to generate any rotation force, and after the first predetermined period, while the operation unit is not returned to the neutral region and is maintained in the right-side propulsion force generating region, the ship propulsion device controller causes the plurality of ship propulsion devices to set the first rotating moment in the ship to zero and to keep generating a right-side propulsion force for moving the ship to a desired direction in which the operation unit is instructed, and wherein, in a state in which the operation unit is moved from the neutral region to the left-side propulsion force generating region and maintained therein, the ship propulsion device controller causes the plurality of ship propulsion devices to generate a second rotating moment that is a rotating moment in a direction in which the front portion of the hull relatively moves to the left with respect to the rear portion in the ship during only a second predetermined period from immediately after the operation unit is moved to the left-side propulsion force generating region, without the operation unit being instructed to generate any rotation force, and after the second predetermined period, while the operation unit is not returned to the neutral region and is maintained in the left-side propulsion force generating region, the ship propulsion device controller causes the plurality of ship propulsion devices to set the second rotating moment in the ship to zero and to keep generating a left-side propulsion force for moving the ship to a desired direction in which the operation unit is instructed.

2. The ship propulsion device controller according to claim 1, wherein the plurality of ship propulsion devices comprises a right ship propulsion device disposed on a right part of the rear portion and a left ship propulsion device disposed on a left part of the rear portion, wherein the right ship propulsion device generates a propulsion force in a right-backward direction forming a first acute angle with respect to a front-to-rear direction of the ship during the first predetermined period and generates a propulsion force in a right-backward direction forming a second acute angle, which is larger than the first acute angle, with the front-to-rear direction of the ship after the first predetermined period, while the operation unit is not returned to the neutral region and is maintained in the right-side propulsion force generating region, wherein the left ship propulsion device generates a propulsion force in a right-forward direction forming a third acute angle with respect to the front-to-rear direction of the ship during the first predetermined period and generates a propulsion force in a right-forward direction forming a fourth acute angle, which is larger than the third acute angle, with the front-to-rear direction of the ship after the first predetermined period, while the operation unit is not returned to the neutral region and is maintained in the right-side propulsion force generating region, wherein the right ship propulsion device generates a propulsion force in a left-forward direction forming a fifth acute angle with respect to the front-to-rear direction of the ship during the second predetermined period and generates a propulsion force in a left-forward direction forming a sixth acute angle, which is larger than the fifth acute angle, with the front-to-rear direction of the ship after the second predetermined period, while the operation unit is not returned to the neutral region and is maintained in the left-side propulsion force generating region, and wherein the left ship propulsion device generates a propulsion force in a left-backward direction forming a seventh acute angle with respect to the front-to-rear direction of the ship during the second predetermined period and generates a propulsion force in a left-backward direction forming an eighth acute angle, which is larger than the seventh acute angle, with the front-to-rear direction of the ship after the second predetermined period, while the operation unit is not returned to the neutral region and is maintained in the left-side propulsion force generating region.

3. The ship propulsion device controller according to claim 2, wherein the first acute angle and the third acute angle are equal, wherein the second acute angle and the fourth acute angle are equal, wherein the fifth acute angle and the seventh acute angle are equal, and wherein the sixth acute angle and the eighth acute angle are equal.

4. The ship propulsion device controller according to claim 2, wherein a value of the first acute angle and a value of the third acute angle increase without decreasing on the way during the first predetermined period, and wherein a value of the fifth acute angle and a value of the seventh acute angle increase without decreasing on the way during the second predetermined period.

5. A ship propulsion device control method of controlling a plurality of ship propulsion devices disposed on a rear portion of a hull of a ship, wherein each of the plurality of ship propulsion devices comprises a propulsion unit configured to generate a propulsion force of the ship; and a steering actuator, wherein the ship comprises an operation unit configured to operate the propulsion unit and the steering actuator; and a ship propulsion device controller configured to control the plurality of ship propulsion devices, wherein the operation unit is able to be positioned at least at a neutral region where the plurality of ship propulsion devices do not generate propulsion forces for the ship and a right-side propulsion force generating region where the plurality of ship propulsion devices generate propulsion forces for moving the ship in a right direction, a right-forward direction, or a right-backward direction, or a left-side propulsion force generating region where the plurality of ship propulsion devices generate propulsion forces for moving the ship in a left direction, a left-forward direction, or a left-backward direction, wherein, in a state in which the operation unit is moved from the neutral region to right-side propulsion force generating region and maintained therein, the ship propulsion device controller causes the plurality of ship propulsion devices to generate a first rotating moment that is a rotating moment in a direction in which a front portion of the hull relatively moves to the right with respect to the rear portion in the ship during only a first predetermined period immediately after the operation unit is moved to right-side propulsion force generating region, without the operation unit being instructed to generate any rotation force, and after the first predetermined period, while the operation unit is not returned to the neutral region and is maintained in the right-side propulsion force generating region, the ship propulsion device controller causes the plurality of ship propulsion devices to set the first rotating moment in the ship to zero and to keep generating a right-side propulsion force for moving the ship to a desired direction in which the operation unit is instructed, and wherein, in a state in which the operation unit is moved from the neutral region to the left-side propulsion force generating region and maintained therein, the ship propulsion device controller causes the plurality of ship propulsion devices to generate a second rotating moment that is a rotating moment in a direction in which the front portion of the hull relatively moves to the left with respect to the rear portion in the ship during only a second predetermined period from immediately after the operation unit is moved to the left-side propulsion force generating region, without the operation unit being instructed to generate any rotation force, and after the second predetermined period, while the operation unit is not returned to the neutral region and is maintained in the left-side propulsion force generating region, the ship propulsion device controller causes the plurality of ship propulsion devices to set the second rotating moment in the ship to zero and to keep generating a left-side propulsion force for moving the ship to a desired direction in which the operation unit is instructed.

6. A program for controlling a plurality of ship propulsion devices disposed on a rear portion of a hull of a ship, wherein each of the plurality of ship propulsion devices comprises a propulsion unit configured to generate a propulsion force of the ship; and a steering actuator, wherein the ship comprises an operation unit configured to operate the propulsion unit and the steering actuator, wherein the operation unit is able to be positioned at least at a neutral region where the plurality of ship propulsion devices do not generate propulsion forces for the ship and a right-side propulsion force generating region where the plurality of ship propulsion devices generate propulsion forces for moving the ship in a right direction, a right-forward direction, or a right-backward direction, or a left-side propulsion force generating region where the plurality of ship propulsion devices generate propulsion forces for moving the ship in a left direction, a left-forward direction, or a left-backward direction, wherein, in a state in which the operation unit is moved from the neutral region to right-side propulsion force generating region and maintained therein, the program causes a computer to execute a first step in which the plurality of ship propulsion devices are allowed to generate a first rotating moment that is a rotating moment in a direction in which a front portion of the hull relatively moves to the right with respect to the rear portion in the ship during only a first predetermined period immediately after the operation unit is moved to right-side propulsion force generating region, without the operation unit being instructed to generate any rotation force, and a second step in which after the first predetermined period, while the operation unit is not returned to the neutral region and is maintained in the right-side propulsion force generating region, the ship propulsion device controller causes the plurality of ship propulsion devices to set the first rotating moment in the ship to zero and to keep generating a right-side propulsion force for moving the ship to a desired direction in which the operation unit is instructed, and wherein, in a state in which the operation unit is moved from the neutral region to the left-side propulsion force generating region and maintained therein, the program causes the computer to execute a third step in which the plurality of ship propulsion devices are allowed to generate a second rotating moment that is a rotating moment in a direction in which the front portion of the hull relatively moves to the left with respect to the rear portion in the ship during only a second predetermined period from immediately after the operation unit is moved to the left-side propulsion force generating region without the operation unit being instructed to generate any rotation force, and a fourth step in which after the second predetermined period, while the operation unit is not returned to the neutral region and is maintained in the left-side propulsion force generating region, the ship propulsion device controller causes the plurality of ship propulsion devices to set the second rotating moment in the ship to zero and to keep generating a left-side propulsion force for moving the ship to a desired direction in which the operation unit is instructed.

7. The ship propulsion device controller according to claim 1, wherein, in a state in which the operation unit is moved from the neutral region to a first specified region that indicates one of the desired directions of the right-side propulsion force generating region and maintained therein, after the first predetermined period, while the operation unit is not returned to the neutral region and is maintained in the first specified region, the ship propulsion device controller causes the plurality of ship propulsion devices to set the first rotating moment in the ship to zero and to keep generating a desired propulsion force for moving the ship to a direction indicated by the first specified region, and wherein, in a state in which the operation unit is moved from the neutral region to a second specified region that indicates one of the desired directions of the left-side propulsion force generating region and maintained therein, after the second predetermined period, while the operation unit is not returned to the neutral region and is maintained in the second specified region, the ship propulsion device controller causes the plurality of ship propulsion devices to set the second rotating moment in the ship to zero and to keep generating a desired propulsion force for moving the ship to a direction indicated by the second specified region.

8. The ship propulsion device controller according to claim 7, wherein one of the desired directions indicated by the first specified region is a translational movement in the right direction, wherein one of the desired directions indicated by the second specified region is a translational movement in the left direction.

* * * * *